US006994155B2

(12) United States Patent
Dessiatoun et al.

(10) Patent No.: US 6,994,155 B2
(45) Date of Patent: Feb. 7, 2006

(54) HEAT TRANSFER

(75) Inventors: Serguei Vassilievich Dessiatoun, Colmar Manor, MD (US); Igor Ivakhnenko, Silver Spring, MD (US)

(73) Assignee: Cheiros (Technology) Ltd., Douglas (GB)

( * ) Notice: Subject to any disclaimer, the term of this patent is extended or adjusted under 35 U.S.C. 154(b) by 294 days.

(21) Appl. No.: 10/257,051

(22) PCT Filed: Apr. 11, 2001

(86) PCT No.: PCT/GB01/01658

§ 371 (c)(1),
(2), (4) Date: Oct. 8, 2002

(87) PCT Pub. No.: WO01/77602

PCT Pub. Date: Oct. 18, 2001

(65) Prior Publication Data

US 2003/0056943 A1 Mar. 27, 2003

(30) Foreign Application Priority Data

Apr. 12, 2000 (GB) ..... 0008897

(51) Int. Cl.
*F25D 9/00* (2006.01)
*F28F 1/42* (2006.01)

(52) U.S. Cl. ..... 165/165; 165/179

(58) Field of Classification Search ..... 165/165, 165/164, 179

See application file for complete search history.

(56) References Cited

U.S. PATENT DOCUMENTS

| | | | | | |
|---|---|---|---|---|---|
| 1,648,511 | A | * | 11/1927 | Solomiac | 165/166 |
| 2,294,137 | A | * | 8/1942 | Spofford | 148/528 |
| 3,103,971 | A | * | 9/1963 | Freyholdt | 165/165 |
| 3,895,675 | A | * | 7/1975 | Rein et al. | 165/164 |
| 3,912,003 | A | * | 10/1975 | Schrade | 165/165 |
| 4,263,966 | A | * | 4/1981 | Ostbo | 165/134.1 |
| 4,484,938 | A | * | 11/1984 | Okamoto et al. | 96/118 |
| 5,150,748 | A | | 9/1992 | Blackmon et al. | |
| 5,390,734 | A | | 2/1995 | Voorhes et al. | |
| 5,845,399 | A | * | 12/1998 | Dewar et al. | 29/890.03 |
| 6,267,175 | B1 | * | 7/2001 | Anderson | 165/166 |
| 6,536,512 | B2 | * | 3/2003 | Kern | 165/150 |

FOREIGN PATENT DOCUMENTS

| | | | |
|---|---|---|---|
| DE | 19654115 | A1 | 6/1998 |
| EP | 0111459 | A2 | 6/1984 |
| EP | 0854345 | A1 | 7/1998 |
| JP | 03204594 | A * | 9/1991 |
| WO | WO 99/51069 | | 10/1999 |

* cited by examiner

*Primary Examiner*—Allen J. Flanigan
(74) *Attorney, Agent, or Firm*—Rosenberg, Klein & Lee

(57) ABSTRACT

A heat transfer assembly is disclosed which comprises at least one wall (1, 2, 3) which is adapted to separate a first fluid at a first temperature from a second fluid at a second temperature, and at least one fiber member (6, 7, 8, 9) or plurality of them, each fibre member (6, 7, 8, 9) including at least one elongate fibre which extends substantially axially along the fiber member (6, 7, 8, 9) from the first fluid through the wall (1, 2, 3) and into the second fluid whereby in use heat is transferred from the first fluid to the second fluid or vice versa, and the entire heat transfer assembly or a part of it is assembled as a single unit by sewing/weaving/stitching technique.

8 Claims, 19 Drawing Sheets

HEAT TRANSFER

This invention relates to improvements in heat transfer, and in particular but not exclusively to a group of improved assemblies including heat exchangers and heat sinks which have been developed as a result of research into certain problems that effect this group of assemblies.

Traditionally heat exchangers and heat sink devices have been fabricated from metals or their alloys. These materials have traditionally been used because of their good thermal conductivity and the fact that they are robust and easy to fabricate into rigid assemblies. Copper and aluminium are typically in use, and have thermal conductivity's of between 200 W/mK and 380 W/mK. The main disadvantage has been that the materials are highly susceptible corrosion and relatively heavy.

It has also recently been proposed that heat exchangers are produced in ceramic materials. These materials do not corrode in humid operating environments but are brittle and very difficult to work.

Advances in composite material technology has resulted in the production on commercial scales of non-metallic materials that have excellent mechanical and thermal properties and also low density. For example carbon fibres are available that have thermal conductivity's of in excess of 2000 W/mK whilst retaining a density lower than that of aluminium.

To date, the only attempts to incorporate these new materials into heat transfer assemblies, such as heat exchangers, have been to use the same processes that have been developed for metal designs. For example, this has simply involved the reproduction of a commercially available plate heat exchanger using plates of composite materials. The exchanger comprises wavy sheets of composite material inserted into channels defined between walls of composite material. Unfortunately, due to the need for thermal transfer between the sheets and the walls many of the potential benefits of composite materials are lost. Stresses induced between the fins and the walls due to the bonding material may also result in premature failure.

The applicant has appreciated that prior art heat exchangers and heat sinks and the like can be improved by using composite materials, such as carbon fibre, in a different way to that previously considered possible.

In accordance with a first aspect, the invention provides a heat transfer assembly which comprises at least one wall which is adapted to separate a first fluid at a first temperature from a second fluid at a second temperature, and a plurality of fibre members, each fibre member including at least one elongate fibre which extends substantially axially along the fibre member from the first fluid through the wall and into the second fluid whereby in use heat is transferred from the first fluid to the second fluid.

By providing for one or more fibres to extend through the wall(s) of the heat exchanger there is no efficiency loss that is present when the fibres must transfer heat energy through the walls via a bonding media as in the prior art. This enables the unidirectional heat properties of fibres to be exploited.

The resistance of the heat transfer assembly to pressure within the channels is increased because the fibre members pass through the or each wall. The fibre members also produce turbulence in the channels that improves heat dissipation. It also allows the length of the fluid receiving channels to be reduced making for a more compact and lightweight assembly.

The first and second fluids may be received within respective first and second channels provided on opposing sides of the wall.

A number of walls may be provided. A stack of substantially parallel plates defining the walls, may be provided with a channel being defined between adjacent walls. For example, three parallel channels may be provided which are defined by a stack of two plates disposed one above the other. The fibre members may be provided which extend continuously through all the walls or fibre members may be provided which only extend through a single wall between two channels.

The first and second fluids may comprise different fluids, for example a gas and a liquid or different liquids.

Each fibre member may comprise a number of fibres to form a ligament or fin or other structural element which adds to the rigidity of the finished structure. The thickness and shape of the fibre members is not limited.

In accordance with a second aspect, the invention provides a heat transfer assembly adapted to transfer heat between a first fluid at a first temperature and a second fluid at a second temperature, in which the heat transfer assembly comprises a fibre structure produced by weaving and/or sewing and/or stitching of fibres.

The heat transfer assembly, which may be produced in accordance with the teachings of any of the other aspects of this invention may be entirely fabricated from fibres by stitched, woven or sewn together. Subsequently, said entire fibre structure may be impregnated with any suitable matrix material or several materials, including ceramics such as silicon carbide, carbon-carbon, metals and non-metals by any suitable processes such as material infiltration, chemical vapour deposition (CVD), metal casting, or any other. The invention provides an opportunity to weave/sew/stitch the entire fibre structure and use it or accommodate it with any matrix including carbon-carbon and/or high temperature ceramics, metal, or other high thermal conductance material, which have much better thermal properties compared to a plastic or resin matrix. The thermal conductivity of the matrix is important because heat should be conducted from single fibres through matrix into fluids.

When, optionally, impregnated with a matrix material this provides additional structural rigidity. However, by selecting appropriate fibres such as carbon fibres it is possible to produce an assembly which is self supporting without the use of a matrix material.

One or more of the fibres forming the fibre members may be woven into or stitched into one or more of the walls. Thus, some fibres in the fibre members may pass through the walls whilst others are stitched or woven into the walls to increase the strength of the assembly under pressure.

If suitable fibres, such as carbon fibre, are used, the structure may be self-supporting without the need for additional resin or matrix material.

This produces an integrated construction which, when pressurised, is able to hold its shape without bonding of the fibre members to the walls.

Of course, the structure may still be impregnated with any matrix, not limited to resin, after the weaving and/or securing of the fibres to form the walls and fibre members.

The heat transfer assembly may comprise a heat exchanger.

Compared to the prior art, the invention provides an opportunity to weave/sew the entire fibre structure and then accommodate it for an application and, if needed, filled with any matrix including carbon-carbon and/or high temperature ceramics, metals or other matrix, which have much better thermal properties compared to a plastic/resin matrix, which can be applied for some applications. The thermal properties of matrix are crucial for many applications. The said fibre structure may form the basic structure of any of the following aspects of the invention.

In accordance with a third aspect, the invention provides a heat radiating assembly comprising a heat source, one or more walls defining at least one channel, and one or more fibre members which extend through the wall or walls from the heat source to the channel whereby in use heat from the source is radiated from the fibre members into the channel.

As for the first aspect of the invention the fibre members pass through the walls which provides excellent thermal efficiency as well as resulting in a strong light weight structure.

The heat source may comprise a hot fluid or other heated body.

For example, the heat source may comprise an integrated electronic circuit such as provided on a silicon chip or an electronic component such as a transistor.

In a further alternative the heat source may comprise a substrate onto which one or more electronic components may be thermally mounted. Suitable components include power transistors such as IGBT transistors or FET transistors. Of course, the substrate may be omitted and the components may be mounted directly onto the one or more walls.

The resulting radiator assembly differs from those known in the prior art in that a woven fibrous structure can be produced using non-metallic fibres for improved heat radiation when compared to metallic members. The fibres passing through the walls as opposed to being bonded to the walls further increases efficiency.

The body or object to be cooled may be formed integral to the heat transfer assembly. Hence, at least part of the body to be cooled (or heated) may be fabricated from the same materials as the fibre members. The body and the fibre members may then be fabricated at substantially the same time, i.e. in the same factory or site in a series of operations or a single operation.

One proposed use of the invention is as a heatsink for an electronic processing device, such as the pentium class of processors for microcomputers. The heat transfer assembly may be bonded directly onto one face of a processor of this type, or indeed other similar circuitry.

Thus, in accordance with a fourth aspect, the invention provides an electronic circuit provided on a substrate, the substrate including a plurality of fibre members extending therefrom through which heat generated by the substrate can be dissipated.

By providing a substrate (which forms one "wall" of the preceding aspects of the invention) with integral fibre members an improved cooling effect can be achieved as the need for a thermally conductive bond between the heat sink (i.e. the fibre members) and the circuit substrate is eliminated.

Integrated electronic circuits commonly referred to as microchips typically comprise a crystal-polycrystal semiconductor on which the circuitry is etched. Then several layers are usually added between the semiconductor and a metallic/ceramic heat sink in order to accommodate the differences in the thermal expansion of materials. All of this is packaged within a protective casing. The need for these layers can be eliminated and the crystal or other semiconductor structure can directly contact the fibres, which are embedded at least at one end in a substrate or even in a semiconductor itself.

It is preferred that the material of the composite structure is selected to have the same coefficient of expansion as the circuit to be cooled. For example, for silicon and silicon carbide electronics silicon carbide or silicon could be used. Any kind of matrix could be used if fibres with extremely low thermal expansion determine the thermal expansion of the composite.

It is known that silicon upon which microelectronics circuits are today formed has a very low coefficient of expansion. Carbon fibres also have a low coefficient and so the substrate can be conveniently formed from carbon fibres, optionally in a binding material with an optional matrix. One face of the composite substrate may be polished and the device bonded/deposited in position onto the polished surface.

Alternatively the material upon which the microelectronics circuit is formed may be deposited directly onto the substrate that supports the fibre members. A suitable layer of material may be applied using ion beam epitaxial technology, thin-film semiconductor technology, or carbon-carbon since recently some modification of carbon was found to be good semiconductor, or other technology.

Indeed, it is also conceived that the material upon which the circuit is to be etched could be deposited directly onto a fibre/rod(tube) member or/and fibre-composite plate to produce a non-planar substrate for circuitry with excellent cooling.

It is envisaged that fibre members may comprise the substrate and a semiconductor itself. Also fibres can be fabricated from existing semiconductors such as silicon carbide, silicon or any other suitable material.

The fibre structure, which comprises heat conductive fibre members (such as rods or loops) integrated into the substrate have an enhanced beat transfer area with much more efficient heat exchange if compared to a planar panel structure.

One or more of the fibres of the fibre members may encase, either wholly or partially the circuit to be cooled. By providing electrically conductive fibres it is possible to protect the circuit from external electromagnetic effects/impulse (EMI) by forming a fibre layer screen and connecting the fibres to a suitable potential such as an earth point.

By providing a fibre structure, which can by analogy be considered to comprise a fur of coated conductive fibres on the substrate a more efficient conversion can be achieved when compared with a planar panel structure.

In the heat transfer assembly of the first, second and third aspects of the invention or the integrated structure of the fourth aspect each or selected ones of the fibre members may have an electrical charge applied to it/them.

The application of an electrical charge can be used to control the orientation of the or each fibre relative to adjacent fibres and/or relative to the wall or walls of the assembly.

Of course it will be readily appreciated that the application of an electrical charge is not limited to heat assemblies in accordance with either of the first three aspects of the invention.

Therefore, in accordance with a fifth aspect the invention provides a heat transfer assembly that comprises at least one wall which is adapted to define a wall of at least one fluid receiving channel and a plurality of fibre members which each extend through the wall and into the channel whereby in use heat is transferred from a first side of the wall to the fluid in the channel and means for applying an electrical charge to the or each fibre structure to control the orientation of each fibre structure relative to the wall.

In a simple arrangement the fibre members of any of the first four aspects of the invention may all be subjected to the same charge so that they repel one another to maintain substantially even spacing between the fibre members. This enables non-rigid members to be employed whilst maintaining dense spacing of the fibre members and will provide optimal exposure of each fibre to the fluid.

In an alternative, if similar charges are applied to adjacent fibres they will attract one another causing the fibre to close up as the fibres try to clump together. This will reduce the spacing between fibres and so reduce the efficiency of heat transfer.

The performance of the heat transfer assembly may therefore be modified by applying different charges to the fibres under the control of a control unit.

It will be appreciated that the fibre members must be adapted to move relative to the substrate. This can be achieved by providing flexible fibre members or at least having flexibility in place where the fibre members and the substrate congregate. The fibre members need not be completely flexible, and may comprise both flexible and rigid portions. A mixture of the various types of fibre members, some rigid some flexible, may also be provided in a single structure.

By varying the electrical charge applied to one or more of the fibre members it may be possible to change the angle at which a particular fibre is oriented. This may comprise applying differing polarities and magnitudes of charge to one or more of the fibre members. Thus, tuning of an antenna could be performed. At the same time said antenna can be a heat transfer cooling/heating system.

An example of such a structure within the scope of this aspect of the invention is the provision of a fibre bundle comprising a number of fibre members which are bonded to each other at both ends of the fibre bundle but are free therebetween. After being electrically charged, said structure will form spheroid/bottle like object. Such structures can be used as electrically controlled antennas/radiators or electrically controlled shifting mechanism for satellites.

It has been found that electrically charging the fibres in a channel with either negative/positive potential or an alternating potential can enhance the operation of the heat transfer assembly, increasing convection heat transfer from surfaces to fluid and vice versa. In such assembly dielectric or gas fluid is disturbed by generated electrical charges or the applied electrical field disturbs the dipole structure of a fluid, thus destroying thermal layers of fluid electromechanically and improved conditions of a heat transfer occur.

The walls may be made of electrically non-conductive material whilst the fibre members are conductive or vice versa. One or more of the walls and/or the fibre members may be used as electrodes. For example, carbon fibres and cloth could be used. One or more of the walls may also be made of an electrically insulating material, fibrous or non-fibrous.

In one advantageous arrangement, alternate walls, i.e. opposing walls of a channel may be held at different potentials.

In the case where the heat transfer assembly is adapted to contact a body or object to be cooled (or heated) an electrically insulating layer may be provided. The insulation could be deposited onto the end of the fibres of the fibre members if they are conductive, or the surface of the fibre members after assembly and/or of the walls. The insulation may partially or entirely cover the fibre members.

The provision of the electrical potential to a fibre structure may also be used in other applications. It will be appreciated that the benefits are not restricted to heat transfer assemblies.

Hence, in accordance with a sixth aspect the invention provides a light guiding assembly comprising a substrate having a plurality of fibre members extending therefrom, in which each fibre structure comprises at least one optical fibres which is adapted to guide light from the end of the fibre nearest the substrate to the other end of the fibres, and control means for applying an electrical charge to the fibre members to control the direction in which light is guide by the optical fibres.

In a further (seventh) aspect, the invention provides a solar converter adapted to convert light incident upon the panel into electrical energy and which comprises a substrate and a plurality of fibre members which extend from the substrate, the fibre members having one or more layers of photovoltaic material.

In both the sixth and seventh aspects of the invention, the light may be adapted to pass along only a selection of the optical fibres in the assembly.

The light guiding structure may include a light source which is adapted to produce light that passes along the optical fibres. The light source may be connected to the substrate.

In accordance with an eighth aspect the invention provides a heatsink assembly for a device to be cooled which comprises a hollow body having first and second open ends, an outer surface and an inner surface and which is provided with a plurality of fibre members that radiate generally from a first interior surface of the body across the interior of the body to contact the interior surface of the body in a different area, and in which the body is adapted to contact the device to be cooled substantially at the first area so that the fibre assemblies are in thermal contact with the device.

Providing a heat sink in accordance with the eighth aspect of the invention heat is transferred along the fibre members into the hollow body where it can be passed into cooling fluid flowing through the body.

The fibre members may be in direct or indirect thermal contact with the device to be cooled. They may therefore pass through the body at the first area if direct contact is desired.

The heat sink may be thermally bonded to the device.

The heat sink may have dimensions compatible with a microprocessor chip. It may have a generally clamshell form which is generally tubular with the first area of the body defining a flattened base portion which can be placed in contact with the device to be cooled.

The body may therefore comprise a substantially cylindrical sleeve of material through which fluid can be passed. The material may be a fibrous material which may be woven. It may be impregnated with a bonding resin to form a rigid composite structure, or may be a plastics or resinous material.

A fan may be provided which is attached to the heatsink towards one end of the hollow body, or perhaps within the hollow body. The body may therefore define a cowling for the fan and act as a support for the fan.

The fan may comprise an electrically powered device.

Of course, it is possible to modify the preceding aspect of the invention so that a semiconductor material onto which an electronic circuit can be formed is deposited directly onto first of the body.

More than one device to be cooled may be thermally connected to first area of the body. This area can be extended, more fibre members installed, and thus more devices connected to be cooled. For example, they may be spaced around the outside of the body in several areas. Fibre members may then radiate from each of these areas across the inside of the body.

In accordance with a yet further (ninth) aspect of the invention, an evaporator/condenser is provided by combining a heat transfer device in accordance with the first aspect of the invention with a porous capillary structure sandwiched between the first and second channels.

The above embodiments all have the common feature of at least one fibre member and in many arrangements one or more walls. These features may take many forms.

In most cases it is an important feature of the invention that the fibre members have a high thermal conductivity. This can be achieved though the use of fibres having a conductivity of at least 200 W/mK. For example carbon fibres may be used which have a conductivity of around 2000 W/mK.

One or more of the fibre members may include surface perforations or depressions. The fibre members may include metallic or other fibres to conduct electricity. Other suitable fibres include carbon thread, or silicon dioxide or sapphire fibres. A mixture different fibre types may be provided as part of a single fibre member.

A benefit of providing the depressions is that the surface area of the fibres is increased and so the heat transfer properties of the fibres are improved.

The surface and structure of fibre members, walls and structural members may be fabricated in order to control heat transfer features on macro and micro levels: 1) with different roughness and 2) different porosity and size of pores and 3) different directions of pore channels pores on micro level, and on macro level—fibre members may include surface perforations, depressions, grooves, outstanding fibres, etc.

Despite superior thermal conductivity the fibre heat transfer structure has much higher heat transfer surface, therefore effectiveness of heat transfer in fibre structures can be much higher than in conventional metal structures. This is simply true for single-phase heat transfer. For phase change heat transfer this advantage can be much higher if the composite structure is properly designed.

In order to enhance heat transfer in the boiling process, the surface on which this process occurs should be increased and conditions for nucleation site generation improved. At the same time during condensation, condensed fluid should be taken away from the heat exchange surface of condensation. Two of the many advantages of the invented fibre structures are that the surface of the fibre is substantially larger than any state-of-the-art heat transfer surface, plus, the surface of the fibre could be easily enhanced and improved for boiling nucleation purposes, for example, chemically. The carbon fibre surface can be "activated" by oxidisation and nature of "pits" is very suitable for nucleation sites. Moreover, fibres easily form capillary channels, which collect working fluid inside leaving other surfaces dry for better condensation. At the same time, some bigger channels should be provided for fluid transportation. Thus, said fibre members of the said heat exchange assemblies can be designed using all said conditions and points.

One or more of the fibre members common to each of the above aspects of the invention may be charged electrically.

One or more of the fibre members may be adapted to form at least one capillary channel for transporting cooling/heating liquid to the object of cooling/heating or from the object heating by capillary action. This capillary structure forms a wick structure for capillary thermal management system. A variety of different material fibres with different internal structure could comprise a wick.

Heat transfer assemblies including capillary cooling channels use desiccating or absorbing heat energy and capillary action of the wick for transport working fluid. These are passive systems and don't have moving parts. They don't require additional energy for transporting working fluid, are quiet, and are extremely reliable.

In one arrangement, it is envisaged that a fibre member defining a capillary channel may be attached to one wall of the fibre heat exchange assembly.

Alternatively, the or each wall, structural member, or fibre member of the heat transfer assembly may comprise a capillary structure. A plurality of walls, structural members or fibre members form a capillary structure which can be used for transporting, by capillary action, working fluid which evaporates from the capillary structure (absorbing heat from the heat transfer assembly) or condenses on the wall, structural member, or fibre member, absorbing by capillary structure (supplying heat to the heat transfer assembly)

The channel or channels of this heat transfer assembly can be open and liquid can evaporate into its surrounding or space providing evaporative cooling, for example, for a space station escape module. Liquid can also condense on the walls, structural members and/or fibre members of an open channel and be collected as, for example, water vapour from air. In most applications, one or more channels are closed and fibre capillary structure provides circulation of cooling fluid in the system. In the closed channel capillary structure can occupy part of the channel for transporting liquid. Part of the channel or separate channel has to be open for vapour circulation.

One or more walls of the channel or channels can be comprised of a capillary structure, separating liquid channels from vapour channels or it can be the wall of one channel attached to the object of heating/cooling. The rest of the channel space may be used for vapour circulation. The structural member in the channel can comprise the capillary structure. It also can separate liquid and vapour channels, occupy part of the channel or form the channels inside of it. The fibre members themselves can form the capillary structure if the distance between them or between fibres inside them is small enough to provide the capillary action or the internal structure of fibre can provide the capillary action.

Also the capillary structure can be formed by a combination of different elements of the heat transfer assembly. As was mentioned above, the fibre members can form the capillary structure, which will provide the evaporating pumping head for circulating cooling fluid in the system. If the distance between the walls is small enough it will have sufficient capillary pumping pressure on the corners between the structural member and the wall for circulation of cooling fluid. Varying the wall profile in one channel geometry can create a similar structure.

Where walls are provided to define one or more channels, the channel(s) may be open sided, thus allowing heat from the heat source to be radiated in a controlled manner through the fibres into the open channel. Alternatively the channels may be closed sided. The ends of at least one fibre member may terminate within the channel to allow heat to pass into the fluid surrounding the entire fibre member and its end by convection, conduction and radiation.

Composite materials are preferred for the fibre members and the walls, such as a structure having carbon or silicon dioxide fibres, possibly in a resin. It is important that the fibres have a good thermal (e.g. very high or very low) conductivity at least axially with respect to the fibres.

Preferably one or more of the fibre assemblies comprises at least one nonmetallic thread or ligament. The thread may comprise a carbon thread although many other materials having high thermal conductivity may be used.

Alternatively, the fibre members may each comprise a plurality of threads or ligaments which are woven, threaded or bonded together to form a thicker structure than a single thread.

The or each wall may comprise a woven sheet of fibres. The fibres may be the same as those used to form the fibre members or may be different material. It is preferred that the fibres of the walls have a lower thermal conductivity than those of the fibre members to reduce heat transfer between the fibre members and the walls.

It is envisaged that in at least one advantageous arrangement the apparatus comprises both walls and fibre members that are produced using conventional weaving or sewing techniques. It is therefore not necessary to include binding material (i.e. matrix) to hold the assembly together. It could therefore be entirely constructed by sewing or weaving if desired.

Stitches may be made by sewing a thread consisting of a single strand of fibre, which may be continuous or discontinuous, or by stitching using a thread made from multiple strands. Alternatively, the threads may comprise braids or tapes made up of many strands.

Of course, the walls may be fabricated from non-fibrous materials such as polymeric resin, plastics material or ceramic material or some other material in some embodiments, or perhaps of combination of various materials in one assembly.

A plurality of walls may be provided that define first and second closed channels down which the two fluids can be passed. The walls may be parallel to one another or perhaps non-parallel.

The walls may be substantially planar or non-planar and may be defined by opposing sides of one or more plates of fibrous material or polymeric or plastics material. For example a structure comprising a stack of generally rectangular walls may be provided, or the walls may form a set of concentric, i.e. nested cylinders with the channels defined therebetween and the fluid flowing generally axially relative to the cylinders. Other possible shapes are envisaged, i.e. triangular, polygonal.

The provision of concentric nested walls can be used to especially good effect.

Thus, in accordance with a still further aspect the invention provides a heat transfer assembly for a gas turbine or the like in which the heat transfer assembly is in accordance with any one of the preceding aspects of the invention and has at least three concentrically arranged walls; a first inner wall, an intermediate wall and a second outer wall defining at least two annular channels therebetween that surrounds at least a part of the gas turbine, one or more of the fibre members passing through the intermediate wall to remove heat energy from fluid within the channel.

This arrangement reduces the amount of space required when compared with a remotely located recuperator. Furthermore, due to the high structural rigidity that can be achieved, weight savings can be made as the heat transfer assembly may form a structural part of the gas turbine. It may form a structural casing surrounding the gas turbine.

As well as gas turbines, it will be appreciated that the invention has other applications, for instance in cooling ovens or other types of engine.

In a refinement, an additional wall can be provided which is concentric with the outer wall and which is adapted to define a further channel that may receive fluid such as water. The heat energy extracted from the exhaust gas can then be used to heat the water.

It is preferred that the fibre members pass through all of the walls to transfer heat from the hot exhaust gas into a cooling fluid and then the water on opposing sides of the wall. One or more of the fibre members may extend radially from one wall to a more outer wall. They may comprise strips or fins and may be shaped to form an aerofoil.

In accordance with another aspect, the invention may provide a gas turbine or other engine incorporating a heat transfer assembly according to the preceding aspect of the invention.

In order to further improve heat transfer efficiency of the assembly, the cylindrical channels can be subdivided into smaller channels by inserting a structural member or baffle that divides each cylindrical channel into a number of subchannels. This may comprise a corrugated structure and may be fibre based.

The fibre sheets and/or the fibre members may be impregnated with a binding material to form a composite structure. This is advantageous in some situations as it enables a light and highly rigid assembly to be produced. As is known in the art of composite material fabrication, the properties of the heat exchanger may be altered by weaving or laying up the fibres in more than one direction to control dissipation of stress in the assembly. The binding material may comprise a polymeric resin which may be applied to fibrous material after it has been woven into the desired configuration defining the fibre members and the walls. This provides the advantage that no glue is used to bond separate walls to the fibre members and produces a single integrated assembly.

The binding material may be added to the fibres to produce the final composite assembly using carbon-carbon, chemical vapour deposition or plastic precursor techniques or other material infiltration.

The fibre members may be hollow and may be filled with a polymeric resin or other binding material after the assembly has been fabricated to enhance its structural rigidity. Thus for example fibres may be filled with ceramic material such as silicon carbide.

The fibre members may include a protective coating on the outer surface for contact with the fluid in the channels. The coating may, for example, protect the fibres from corrosion.

The fibre members may extend through the walls substantially orthogonal, i.e. at ninety degrees to the walls. Thus provides excellent resistance to expansion stresses caused by the pressure of the fluid in the channels.

Alternatively, the fibre members and the wall may define an obtuse or acute angle other than ninety degrees. One or more of the fibre members may subtend a different angle relative to the walls compared to one or more of the other fibre members. Thus, the fibre members may subtend a number of different angles relative to the walls. This arrangement increases the resistance of the structure to shear stresses, i.e. stresses that lie in the plane of the walls.

In a most advantageous arrangement, the fibre members may pass through the walls so as to form a series of triangles criss-crossing the first and/or second or further channels. This effectively increases the strength of the structure. When combined with binding material to form a composite structure this enables the assembly to function as a structural element. A structural element or baffle may still be provided in this arrangement, and one or more of the fibre members may pass thorough the baffle.

The provision of a criss-cross structure may be further enhanced by filling the area between the walls with a binding material to form a solid composite structure of great strength yet light weight.

The walls of the heat transfer assembly may define at least one closed channel. A reinforcing baffle may be provide within the channel which alternately contacts opposing walls of the channels to define corrugations, which can define sub-channels.

The walls may be parallel or non-parallel to one another and may be planar or non-planar.

The reinforcing baffle preferably comprises a wavy sheet that is provided between the opposing walls of the closed channel. The sheet may be fixed to one wall at its crests and to the other wall at its troughs. The fibre members extending through the walls may also extend through openings in the baffle.

The reinforcing baffle may be impregnated with a binding material at the same time as the walls and/or fibre members.

The reinforcing baffle may be added before, during, or after production of the walls of the channel. It may be bonded to the walls. A number of baffles may be provided between the walls. The corrugations in the baffle may effectively divide the channel into a number of sub channels. Each subchannel may be used to contain fluids of differing types or at differing temperatures.

The or each of the fibre structure may have a uniform or non-uniform cross section along its length such as a circular or oblate cross-section. The members may be spaced uniformly or non-uniformly throughout the channels. For example, the members may comprise discrete rods which are randomly placed in the channel or staggered with members provided at regular intervals. They may comprise elongate strips and may be shaped as an aerofoil to minimise pressure drops as fluid flows across the fibre members. For example, the members may comprise discrete composite or non-composite rods, which are placed in the channel according to some aerodynamic/heat exchange model or staggered with members provided at regular intervals. They may also comprise elongate strips. In order to decrease pressure drop the fibre member can have very special form, such as airfoil or other low drag geometry. The axle of the fibre member cross-section can be parallel to the flow direction, nonparallel, or orthogonal Where the walls are circular, the fibre members may extend radially from the inner wall of a channel to its outer wall. These members may comprise thin strips which extend axially of the channel as well as radially.

Where the heat transfer assembly includes at least two channels, a means may be provided for circulating the second fluid along the second channel and/or the first fluid along the first channel.

At least one of the channels may be open sided, for instance to allow cooling air to contact the fibre structures where they protrude into the open channel. Alternatively, the channels may be closed.

Means may provided for providing an electrical potential to the assembly to enhance the heat exchanging properties of the assembly.

One or more of the walls anlor the fibre members may therefore be made electrically conductive material. For example, carbon fibres could be used. One or more of the walls may also be made of an electrically insulating material.

In one advantageous arrangement, alternate walls, i.e. opposing walls of a channel may be held at different potentials.

By varying the electrical charge applied to one or more of the fibre members it may be possible to change the angle at which light is emitted from the fibres relative to the substrate. This may comprise applying differing polarities and magnitudes of charge to one or more of the fibre members.

The invention as set out in accordance with the preceding paragraphs can be adapted to operate over a wide range of high temperatures by choosing fibre materials that have a very low thermal expansion coefficient. Conversely, this also allows them to be used with fluids at very cold temperatures. In traditional metal heat exchangers, for instance employing Inconnel alloys thermal stress have been found to cause failure of the joints needed to hold the structures together. An assembly produced using suitable fibres, such as carbon fibres, by weaving or like processes overcomes these problems.

In accordance with yet a further aspect of the invention an electronic device is provided which comprises a substrate, an electronic circuit defined on the substrate and one or more optical fibres embedded on or within the substrate with or without other fibres adapted to direct light onto one or more components of the microelectronics circuit.

The light guiding fibres may be used to direct light onto the components defined within the substrate to correct radiation damage of the components.

Looked at another way, this aspect may be a method of cooling and/or correcting the effects of radiation damage on the components of a microelectronics circuit within a substrate by guiding light onto the components through fibres that are integral with the substrate.

In accordance with a still further aspect the invention provides a structural material produced from fibres by weaving/sewing/stitching using fibres. The material may have a similar structure to corrugated cardboard but exceeds the structural properties of corrugated cardboard through the use of advanced materials. Actually, several types of a structural material are envisioned within the scope of the invention.

The corrugated material/structure may comprise at least two walls, and a plurality of fibre members, which may extend through the walls substantially orthogonal to the walls. This produces a structure that is extremely resistant to expansion stresses but not as resistant to shear stresses.

To improve the structure resistance of the structural material to shear stresses the fibre members and the wall may define an obtuse or acute angle other than 90 degrees.

One or more of the fibre members may subtend a different angle relative to the walls compared to one or more of the other fibre members.

The said structural/corrugated material can be also fabricated without inside corrugated baffle but by filling the inside space between walls by some material—for example some plastic such as polyethylene, resin, or rubber.

The corrugated baffle or the filling structural member filling the structure, as said above, can be made using porous material including fibrous materials and used not only as structural material with the ability to work as the heat exchange structure with single or two-phase working fluid.

The filling material or the structural member could be thermally insulating as well as fibres of the said fibres assembly, and said structural material could be advantageous as a reinforced structural thermal insulator. And vice versa, the similar structural material based on high thermal conductivity fibres and filled with high thermal conductivity material, such as graphite felt, porous graphite or other can be high thermal conductivity material with high mechanical properties.

Different variations and mixtures of said structural materials might be envisioned, such as the high thermal conductivity reinforced material with working fluids inside, which will participate in heat exchange process. The said structural/corrugated material can have also non-planar different shapes including tubes.

Any additional structural members like a baffle or filling material could be incorporated into the structural tube. Fibre members, which penetrate walls and structural members of the said tubes, can have different angles between each other and with other parts of the tubes.

All said structural materials and all said in this art fibre heat transfer assemblies can have the residual stresses processed into the structure during fabrication.

Said structural/corrugated carbon or other fibre based materials/structures can be fabricated using orthogonal and non-orthogonal to walls and other elements fibre members, and different shape and directions structural members if they are elected to be installed.

All fibre and non-fibre members and elements of said structural materials could be bonded to each other in proper places or not bonded. Prefabricated stress inside fibre members and structural members is optional. All said structural materials have superior properties, which can be further enhanced by filling matrix.

The invention may provide a structural component of an aircraft, spacecraft or other vehicle comprising the above-defined structural member. This may be adapted to receive a cooling fluid to provide a whole-vehicle-cooling concept. It is envisaged that this could be used to lower a vehicle or crafts thermal signature.

The fibre structures may be very flexible in shape. A plurality of walls may be provided that define first and second closed channels down which the two fluids can be passed. The walls may be parallel to one another or perhaps non-parallel, circular or any other shape including irregular shapes.

There will now be described by way of example only several embodiments of the present invention with reference to the accompanying drawings of which:

Figure 4:
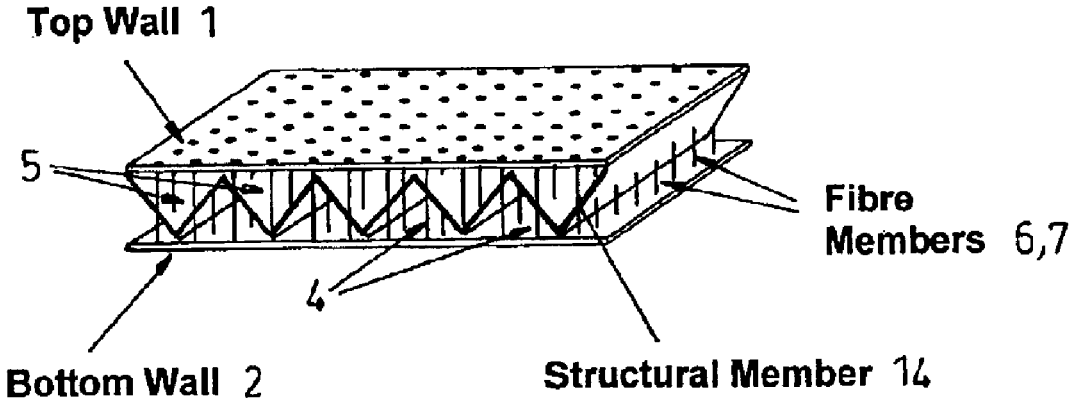
FIG. 4 is a perspective view of a different embodiment of a heat exchanger or the like in which a structural member/baffle divides a single channel into sub-channels along which different fluids may be passed.
Figure 8:
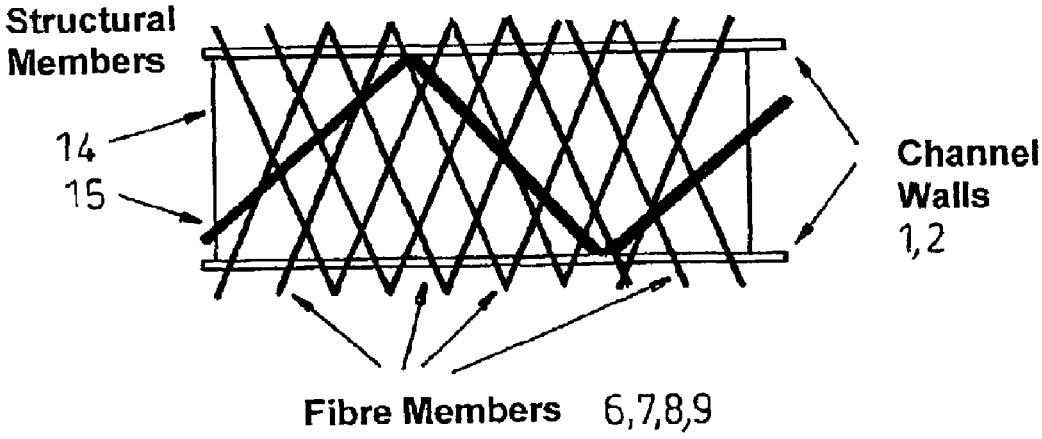
Figure 9:
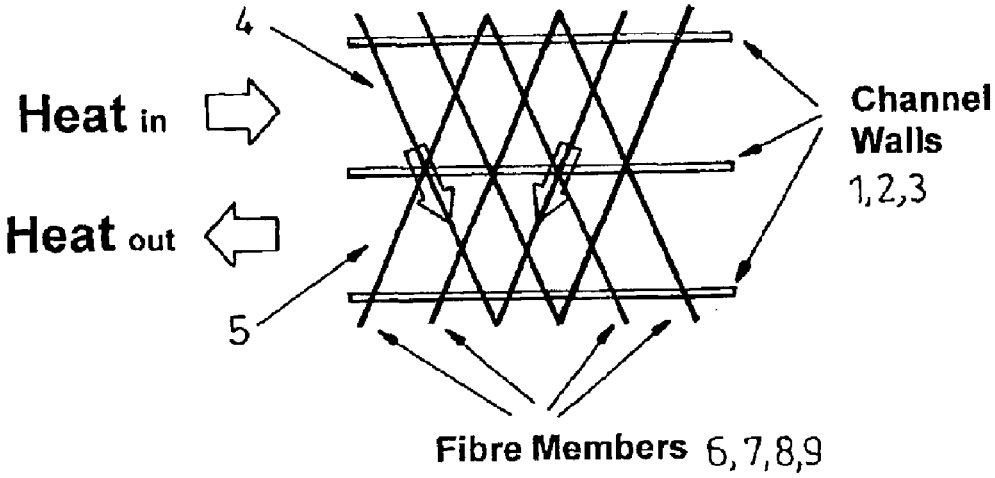
Figure 10:
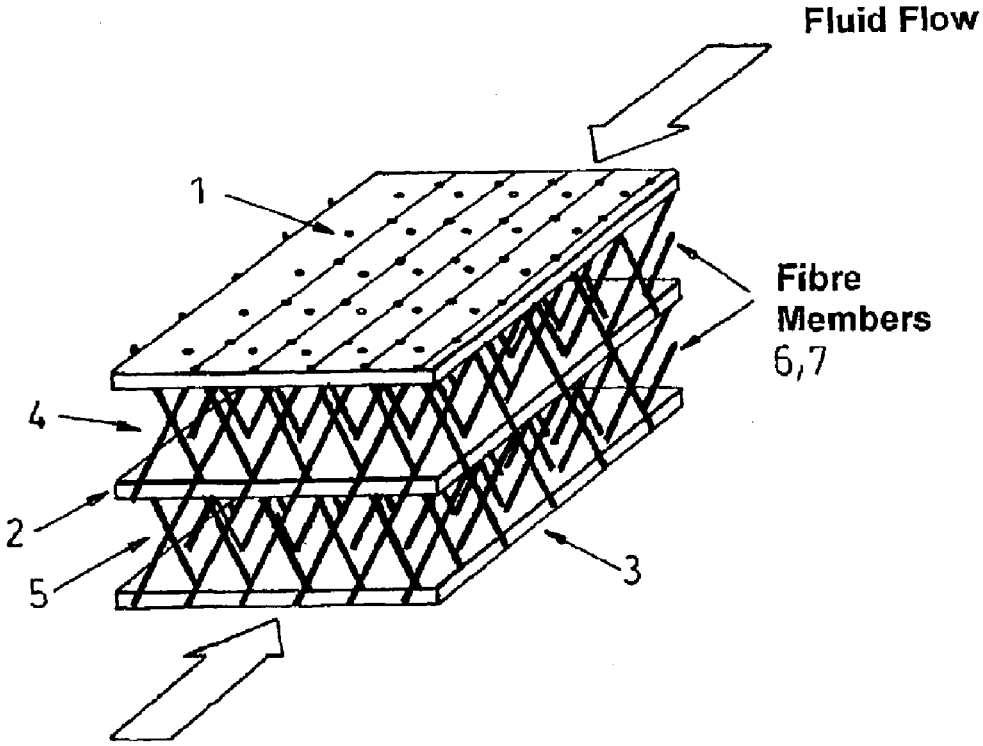
Figure 11:
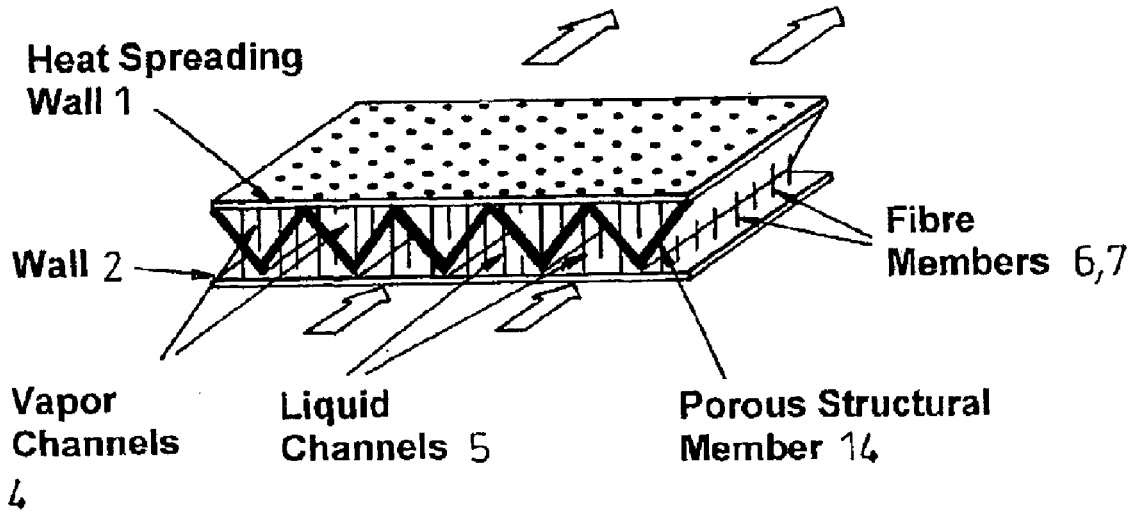
Figure 12:
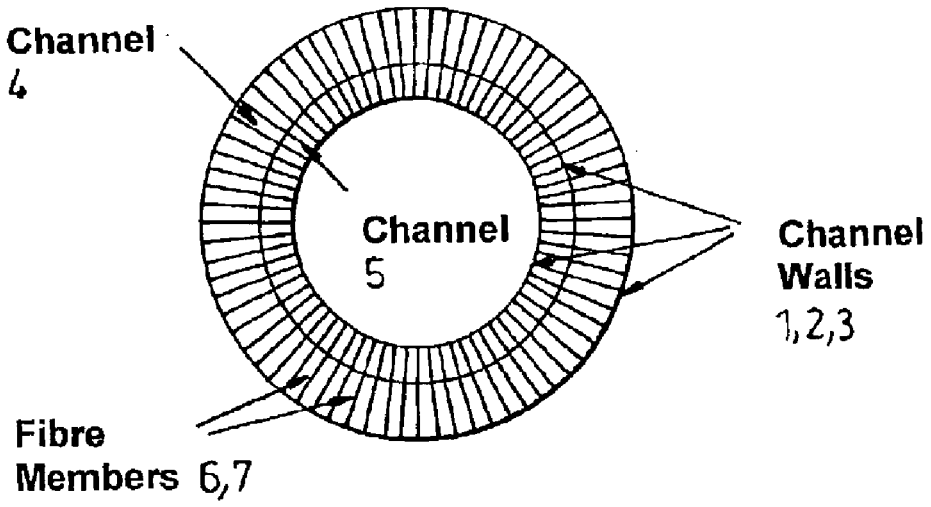
Figure 13:
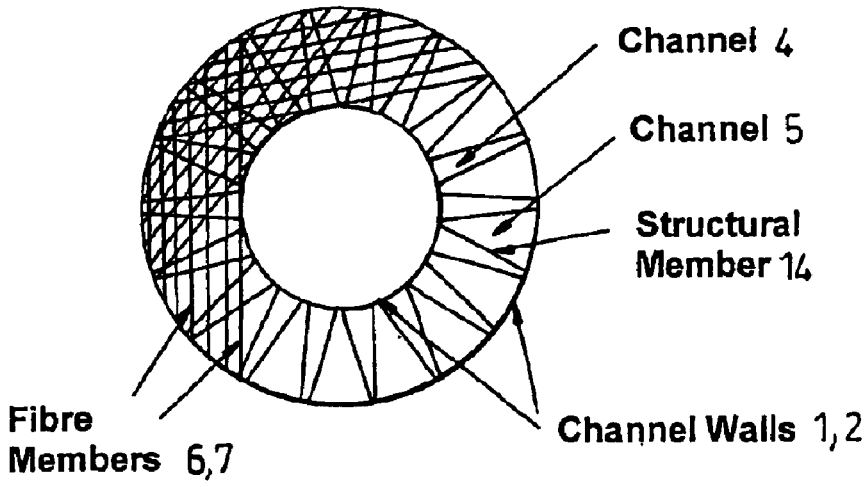
Figure 14:
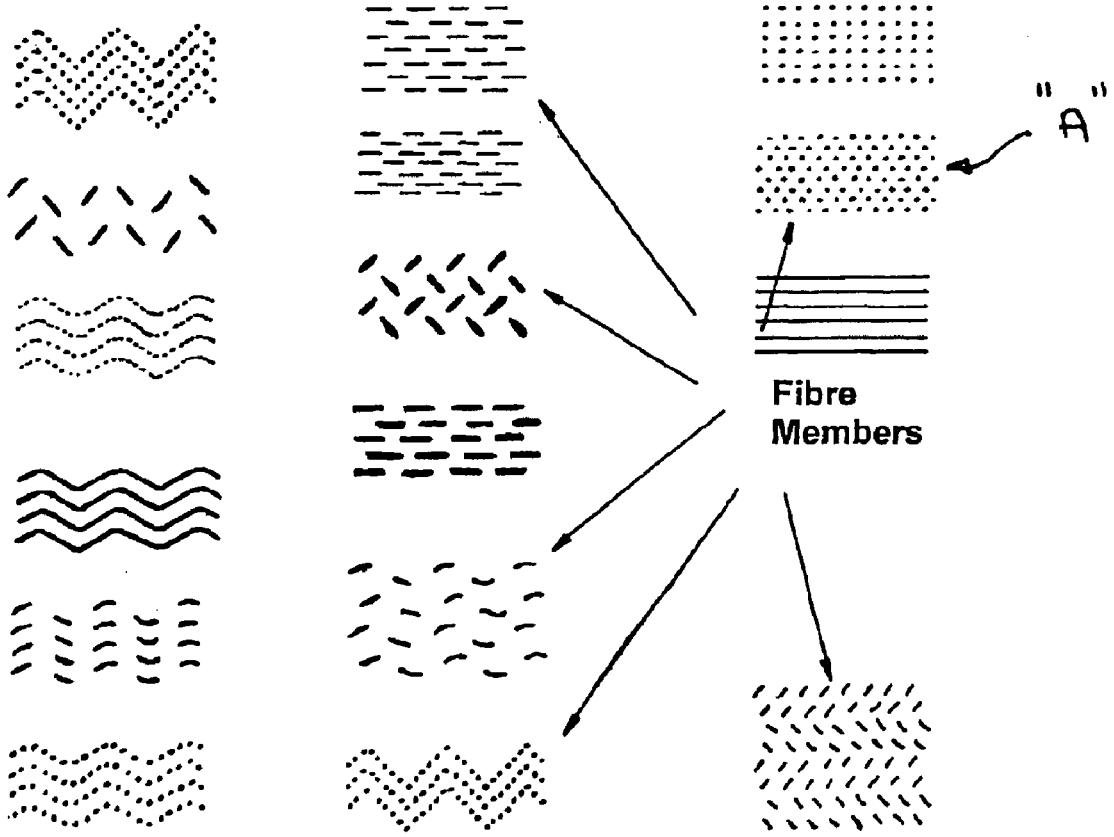
Figure 15:
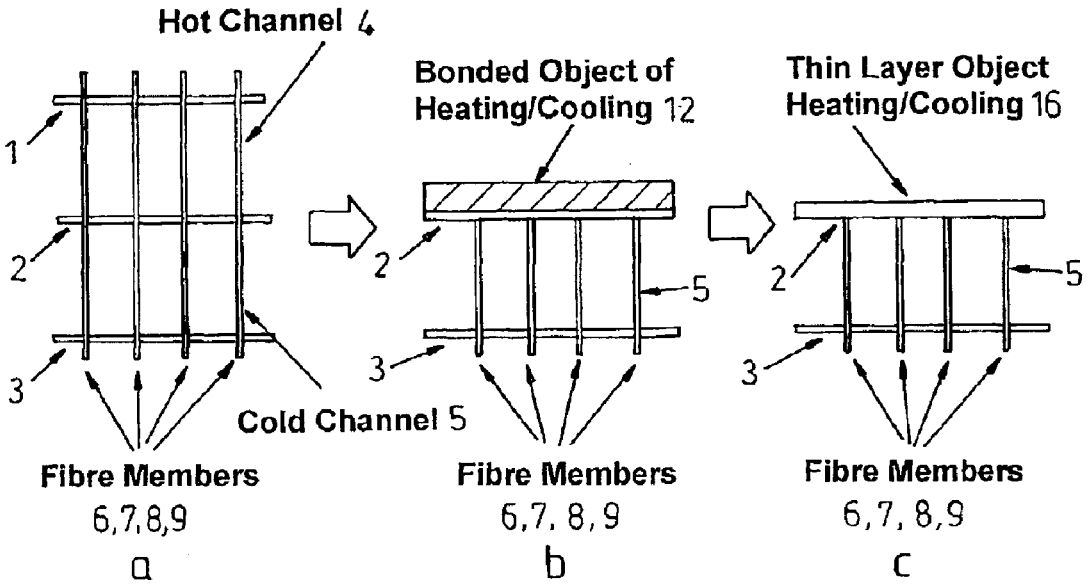
Figure 16:
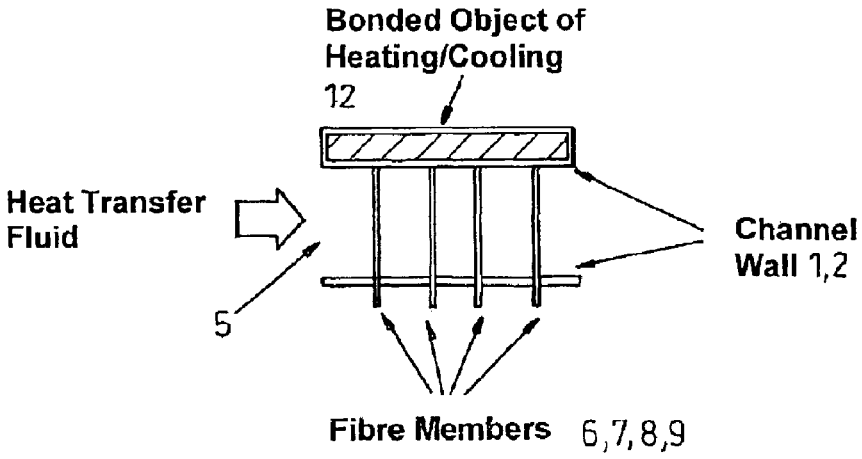
Figure 17:
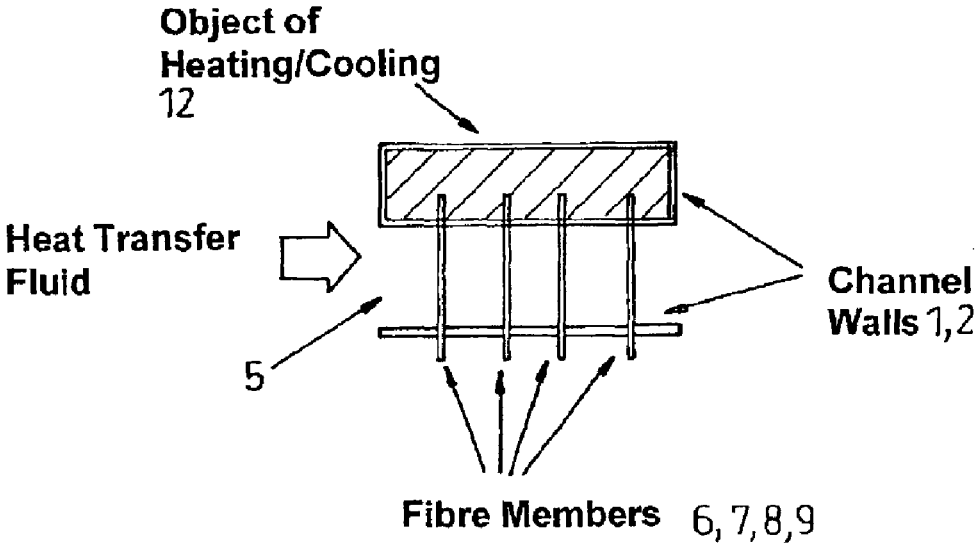
Figure 18:
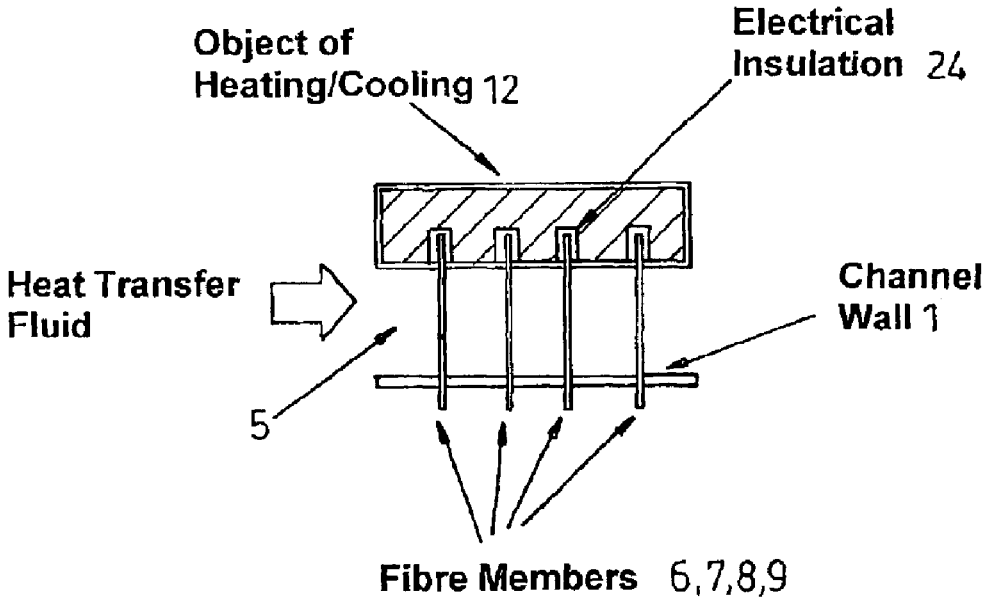
Figure 19:
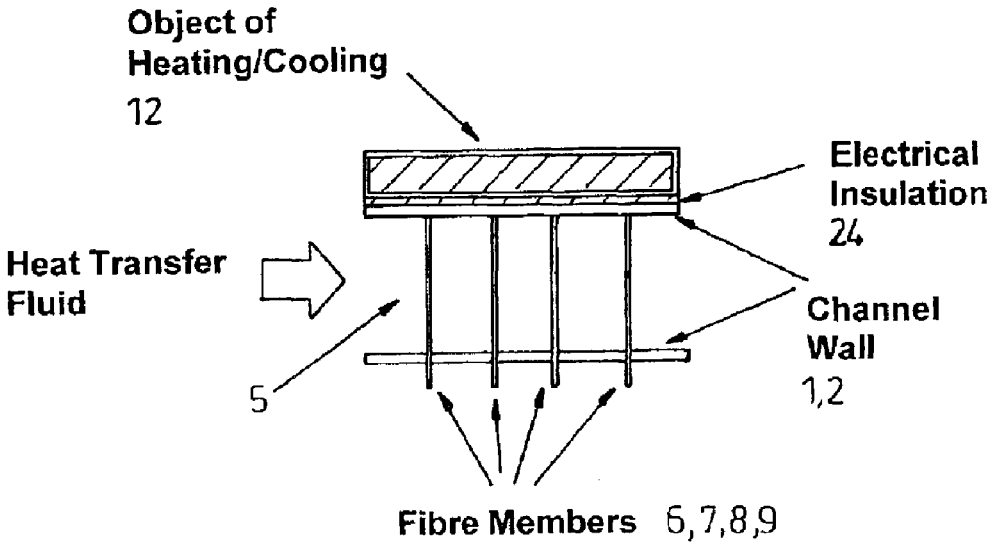
Figure 20:
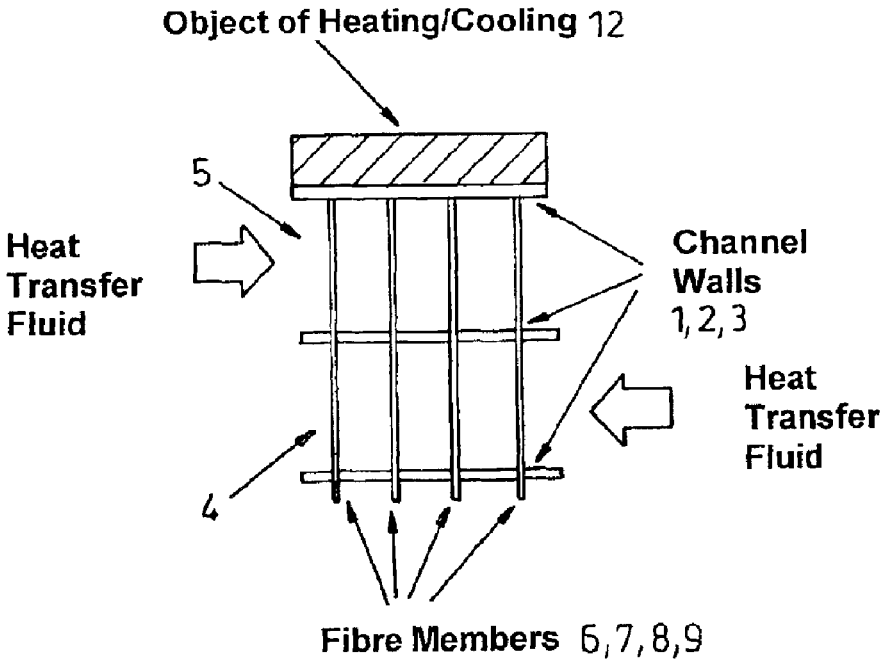
Figure 21:
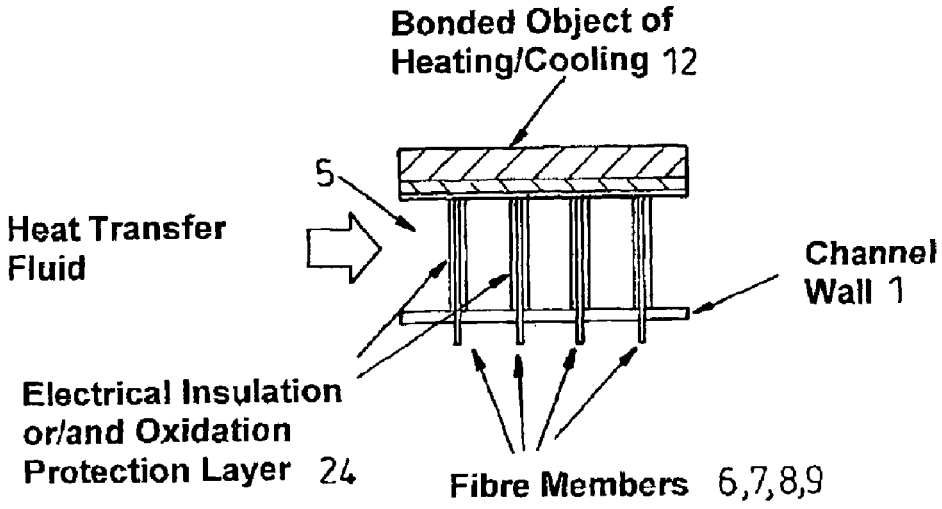
Figure 22:
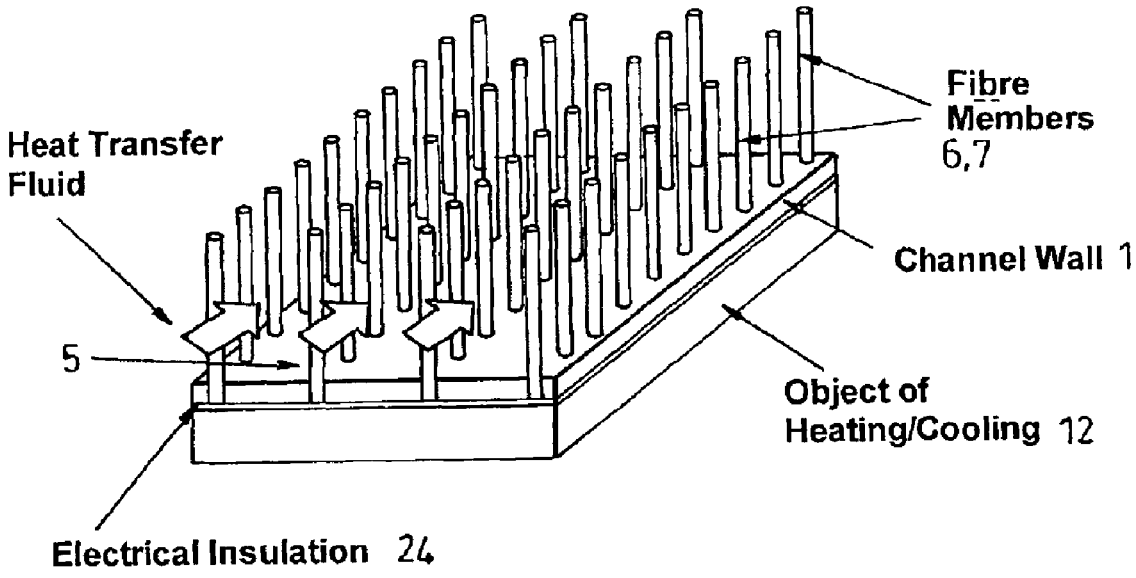
Figure 23:
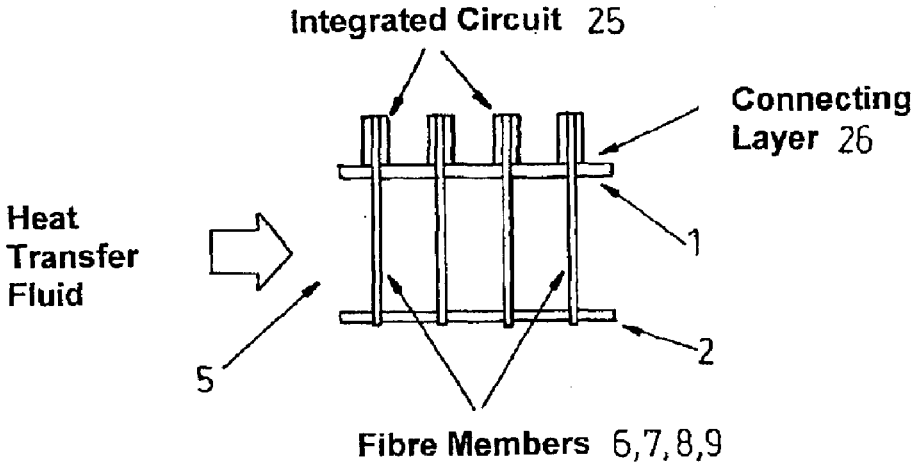
Figure 24:
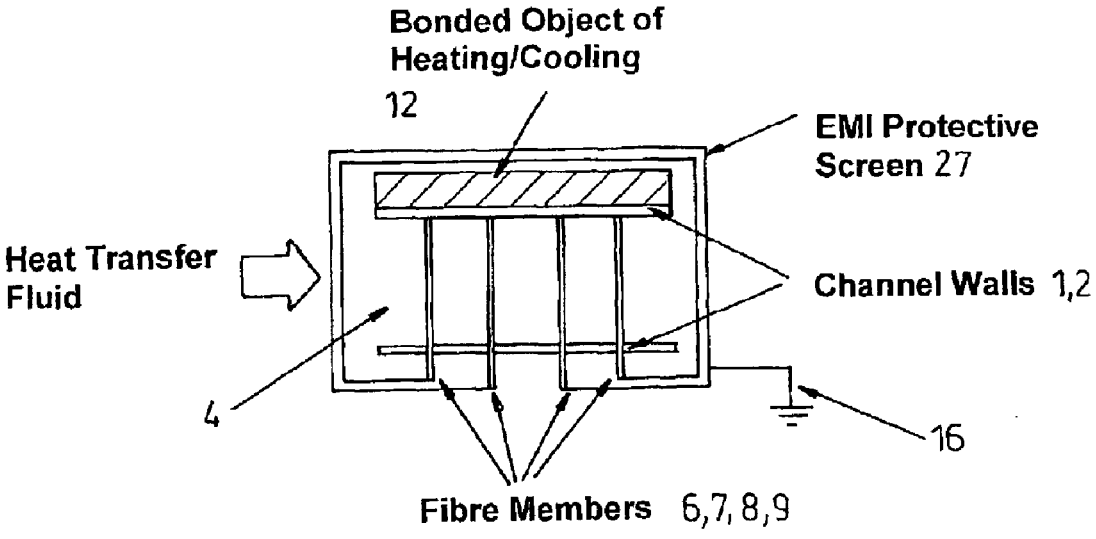
Figure 25:
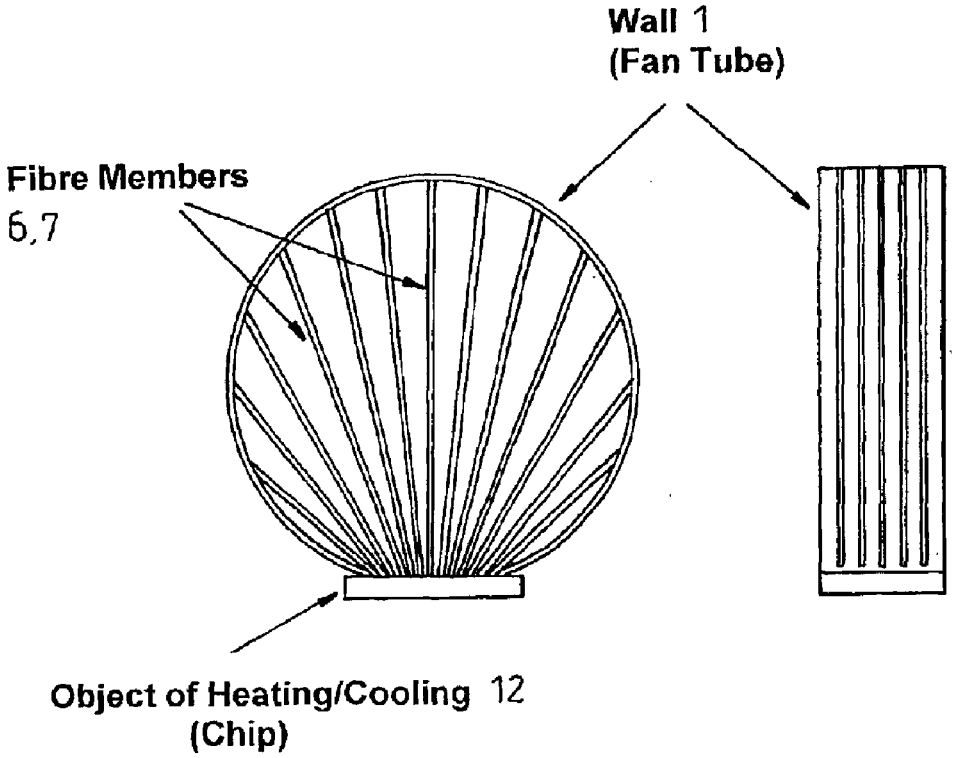
Figure 26:
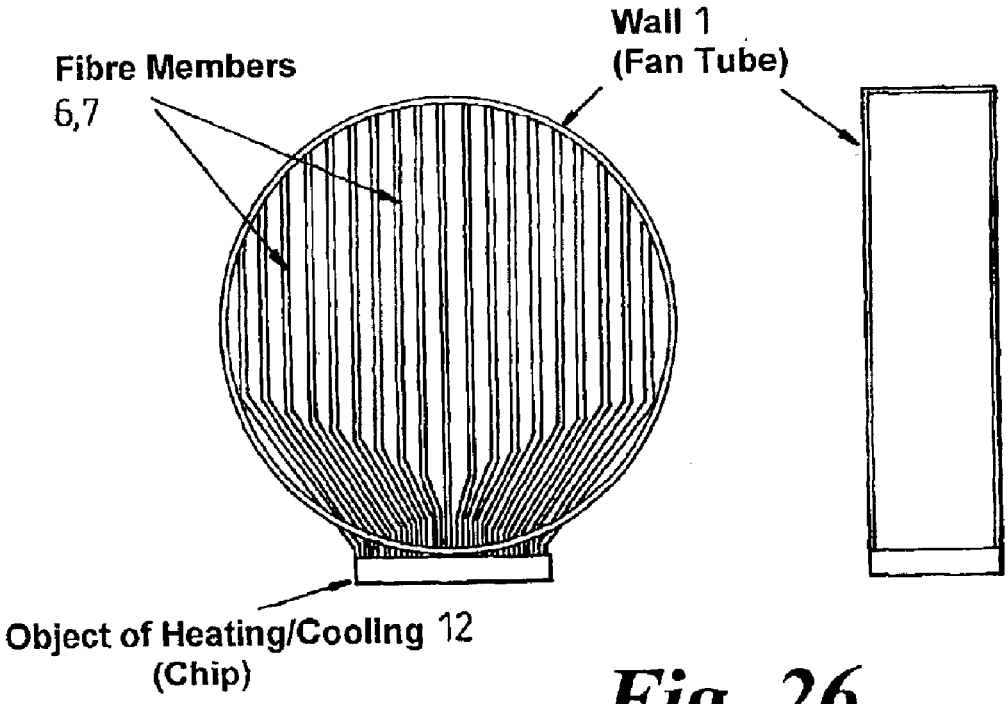
Figure 27:
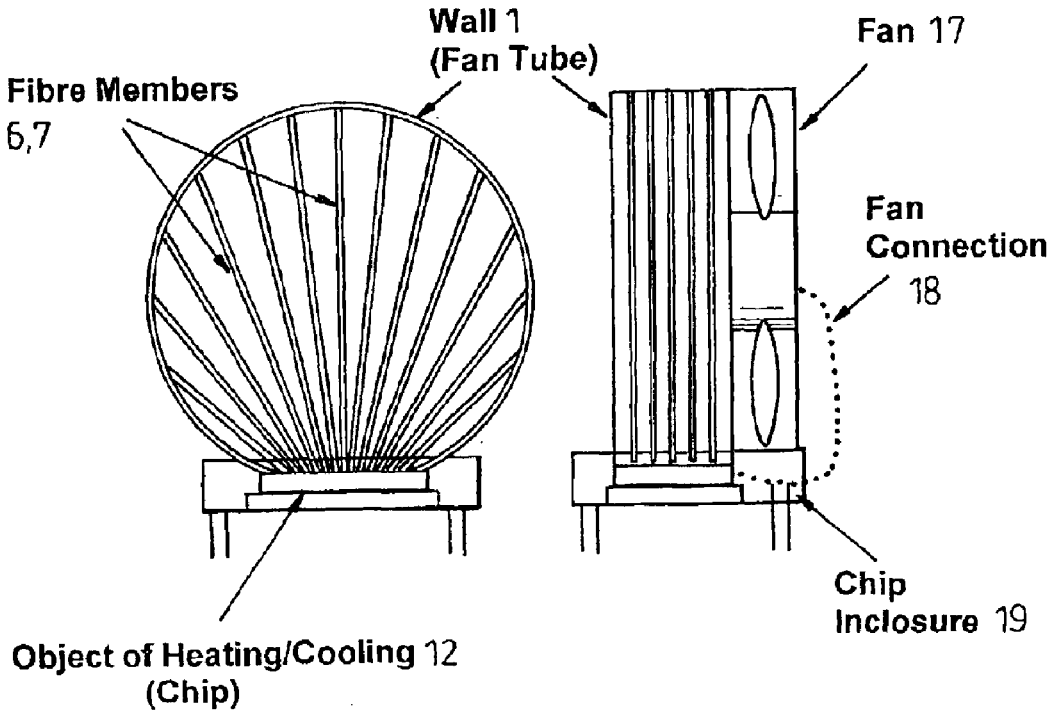
Figure 28:
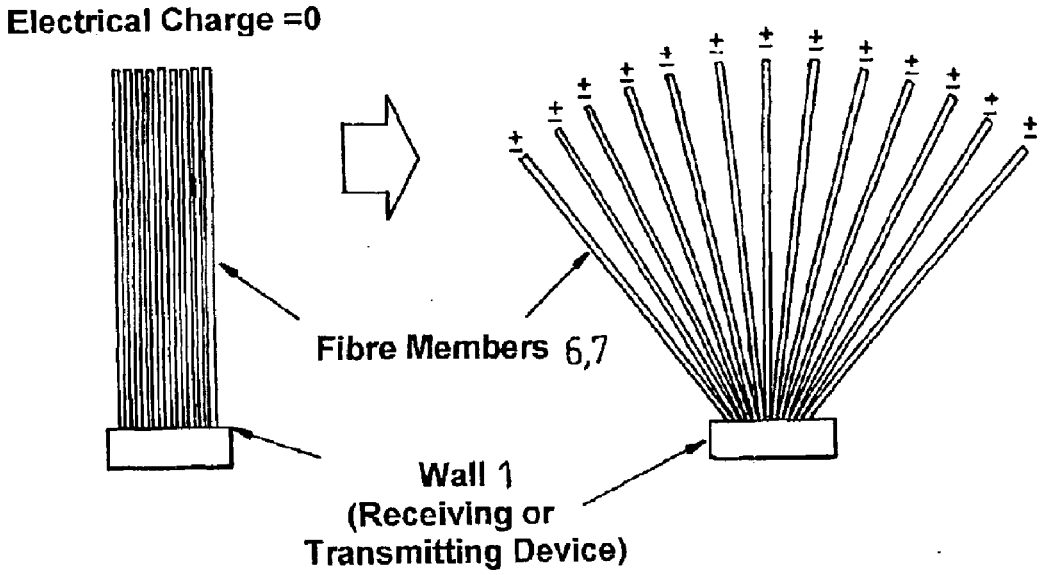
Figure 29:
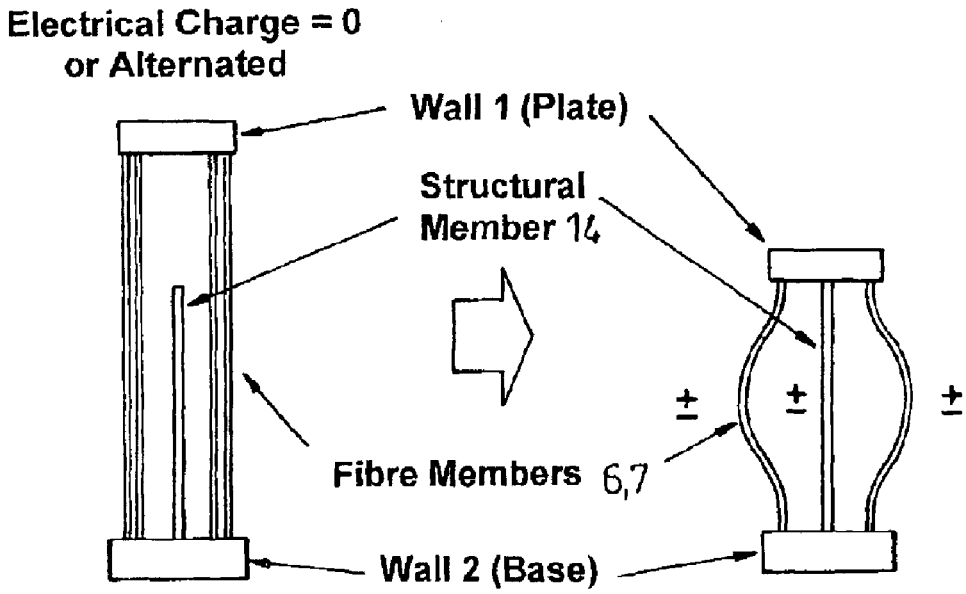
Figure 30:
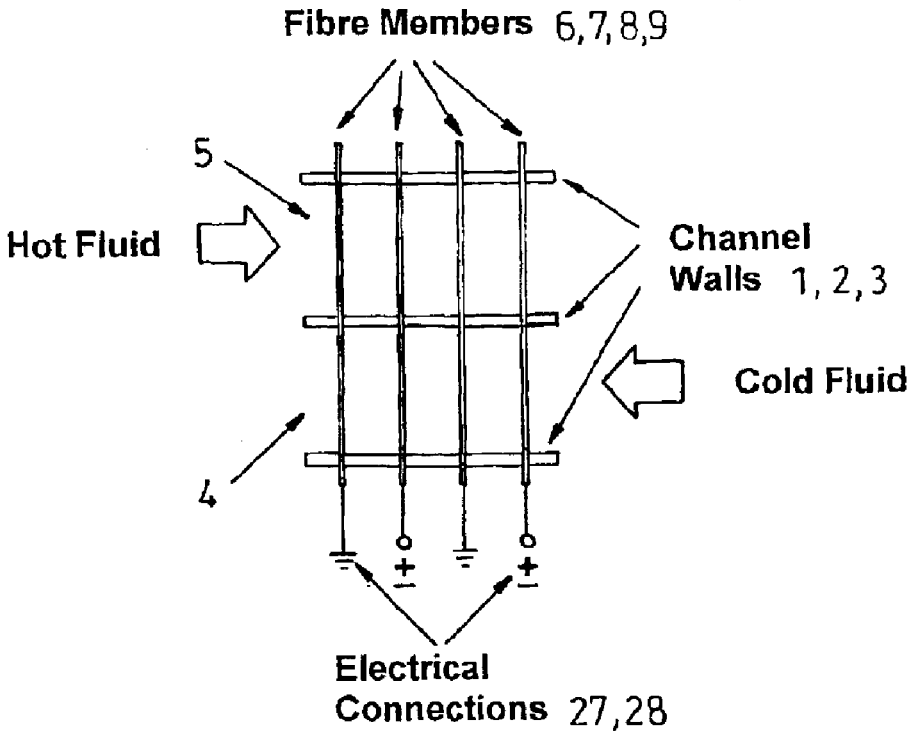
Figure 31:
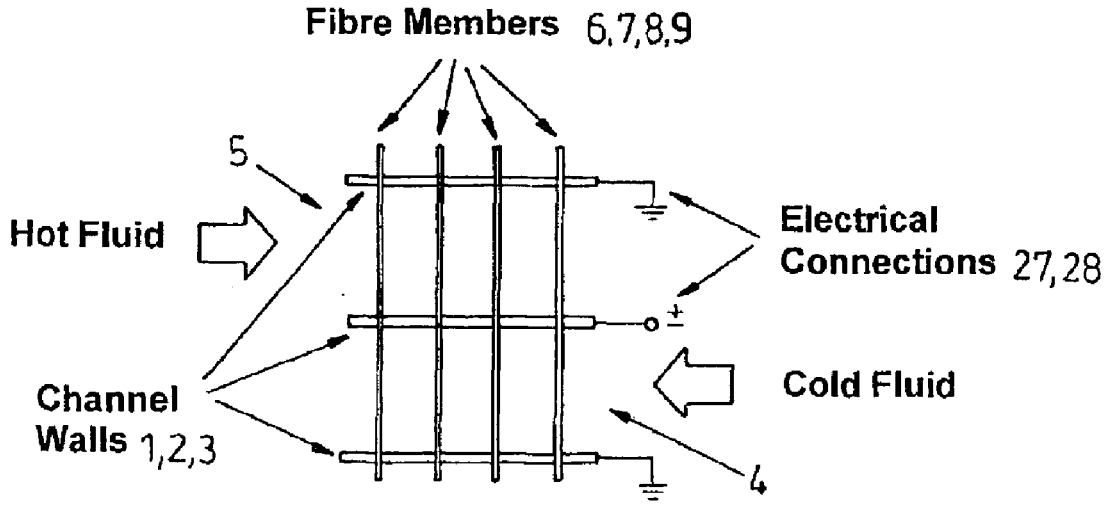

FIG. 8 is a partial cross sectional view of an embodiment of the fibre heat exchange structure or the like in which the fibre members are not orthogonal relative to the plane of the plates with an installed in two structural members. One structural member/baffle, and other structural member filling an entire space between walls. Shown embodiment could be important for a structural material application;

FIG. 9 is a partial cross sectional view of an embodiment of the fibre heat exchange structure or the like in which the fibre members are not orthogonal relative to the plane of the plates;

FIG. 10 is a perspective view of part of the fibre structure illustrated in FIG. 9;

FIG. 11 is an alternative embodiment of the fibre structure illustrated in FIG. 4 in which the structural member/baffle is porous and an entire structure comprises a capillary evaporator/condenser or a special structural material;

FIG. 12 is a cross sectional view of an embodiment of a fibre heat exchange structure or the like having cylindrical walls and fibre members, which are orthogonal to cylindrical plates;

FIG. 13 is a cross sectional view of an embodiment of a fibre heat exchange structure or the like having cylindrical walls similar to those illustrated in FIG. 12, but with an installed reinforcing baffle dividing a channel into sub-channels and fibre members which are not orthogonal relative to the walls;

FIG. 14 is an overhead view of a set of fibre members illustrating some of the various possible spatial arrangement of the fibre members within the heat transfer assembly;

FIG. 15 is an evolution of the fibre heat exchange structure into a heat sink with partial cross sectional views of an embodiment of a heat sink in accordance with the present invention bonded to an object to be cooled or heated, and with an embodiment of a heat sink with an object to be heated/cooled deposited on a wall;

FIG. 16 is a partial cross sectional view of an embodiment of the fibre heat exchange structure, which comprises a heat sink in accordance with the present invention bonded to an object to be cooled or heated;

FIG. 17 is a cross sectional view of an embodiment of a combined device to be cooled/heated and the heat sink in which heat conducting fibres are embedded within the device to be cooled;

FIG. 18 is a cross sectional view of an embodiment of a combined device to be cooled/heated and the heat sink in which heat conducting fibres are embedded within the device to be cooled with an electrical insulation between the device and heat conducting fibres;

FIG. 19 is a partial cross sectional view of an embodiment of the fibre heat exchange structure, which comprises a heat sink in accordance with the present invention bonded to an object to be cooled or heated as illustrated in FIG. 16, but with an electrical insulation layer between the device and the heat sink;

FIG. 20 is an illustration of a heat sink, which comprises a fibre heat transfer structure attached to a device to be cooled; the embodiment defines channels along which heat transfer fluid is passed. The wall to which a device to be cooled/heated is bonded can be removed and the device can be a wall itself;

FIG. 21 is a modification of the heat sink of FIG. 16 in which a coating of protective and/or electrically insulating material is provided;

FIG. 22 is a perspective view of an embodiment of the invented heat sink of FIG. 19;

FIG. 23 is an illustration of a three dimensional micro-electronic circuit deposited on the surface of fibres or other kind of high thermal conductivity members, for example, carbon rods and plates, integrated with a heat sink in accordance with one aspect of the invention;

FIG. 24 is an illustration of a micro-electronic circuit integrated with a heat sink and protected by fibre members from EMI in accordance with one aspect of the invention;

FIG. 25 is a view of a heat sink with a cooling fan, which can be integral with an object to be heated and/or cooled;

FIG. 26 is a view of an embodiment of the invented heat sink of FIG. 25 with a different orientation of fibre members;

FIG. 27 is a perspective view of the invented heat sink of FIGS. 25 and 26 with an integrated microchip shown;

FIG. 28 is an illustration of a still further embodiment of a heat sink design in which the fibre members are electrically charged, and said heat sink design can be used also as an antenna, thermal radiator/receiver a solar battery, a light reflector/receiver, etc. in accordance with aspects of the invention;

FIG. 29 is an illustration of a still further embodiment of a heat sink design of FIG. 28 in which the fibre members are electrically charged, but fibre members are bonded from both ends; said heat sink design can be also used as a thermal radiator, an antenna, a solar battery, a light reflector/receiver, etc. in accordance with aspects of the invention;

FIG. 30 illustrates a modified heat transfer assembly in which the fibre members that pass through the channels are electrically charged and used as electrodes;

FIG. 31 is an alternative to an embodiment shown in FIG. 30 in which the walls of the channels are electrically charged.

Figure 5:
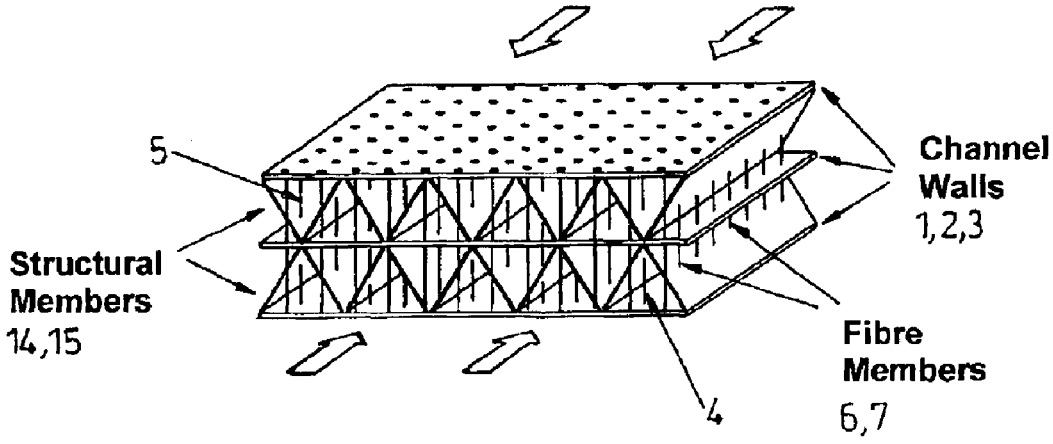
FIG. 5 is a perspective view of a similar to previous embodiment of a heat exchange structure or the like in which structural members or maybe one structural member/baffle divide two channels into sub-channels along which different fluids may be passed.
Figure 32:
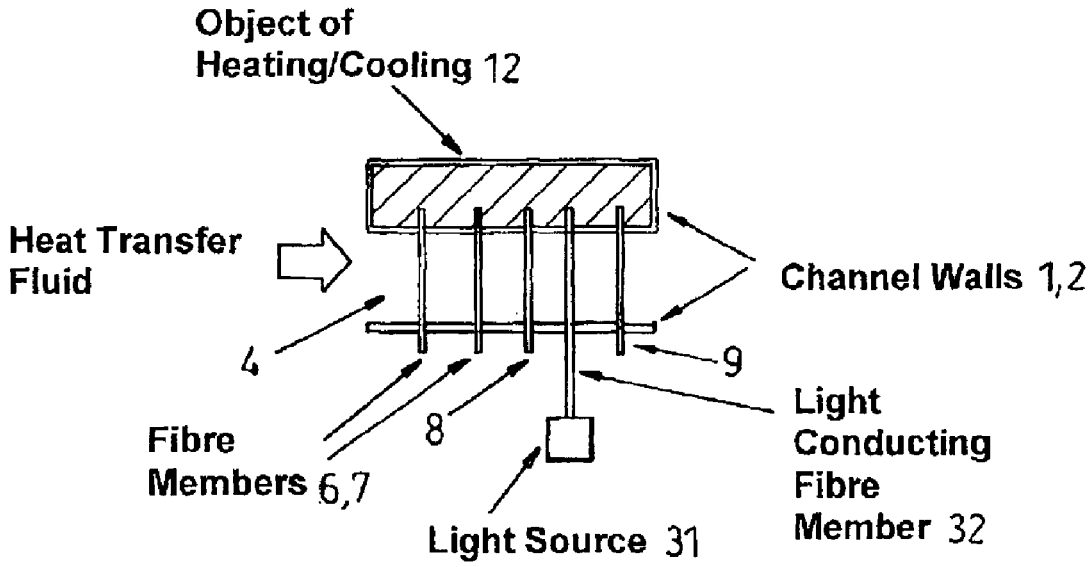
Figure 33:
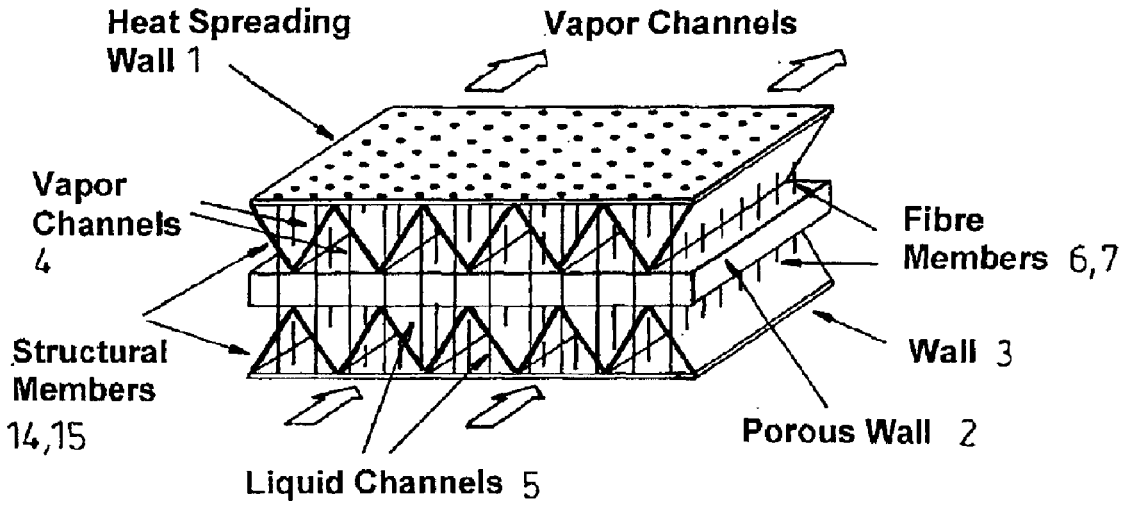
Figure 34:
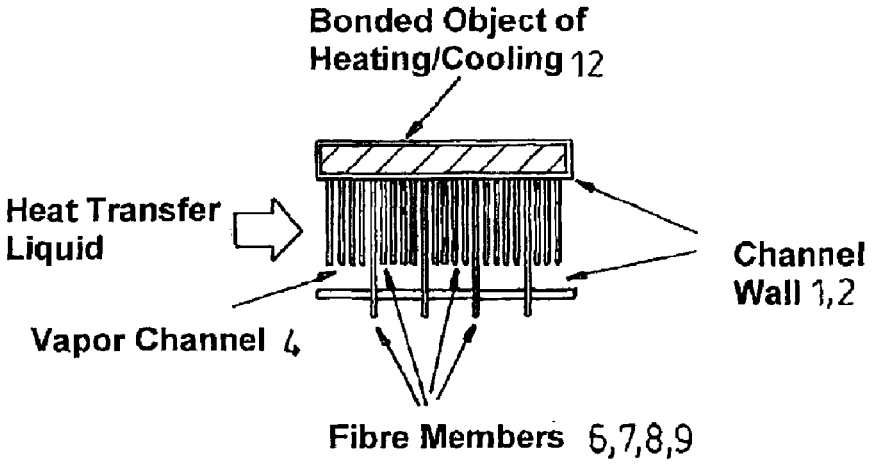

FIG. 32 is a view of an embodiment of the invented heat sink of FIG. 17 in which heat conducting fibres are embedded within the device to be cooled, but at least some fibres are light transparent and transport light into the object to be cooled/heated;

FIG. 33 is an illustration of a capillary evaporator/condenser similar to the heat exchanger of FIG. 5 but with a porous wall, which pumps fluid to evaporate;

FIG. 34 is an illustration of a capillary evaporator/condenser in which the fibre members comprise a capillary structure attached to a wall of the fibre heat exchange structure.

Figure 35:
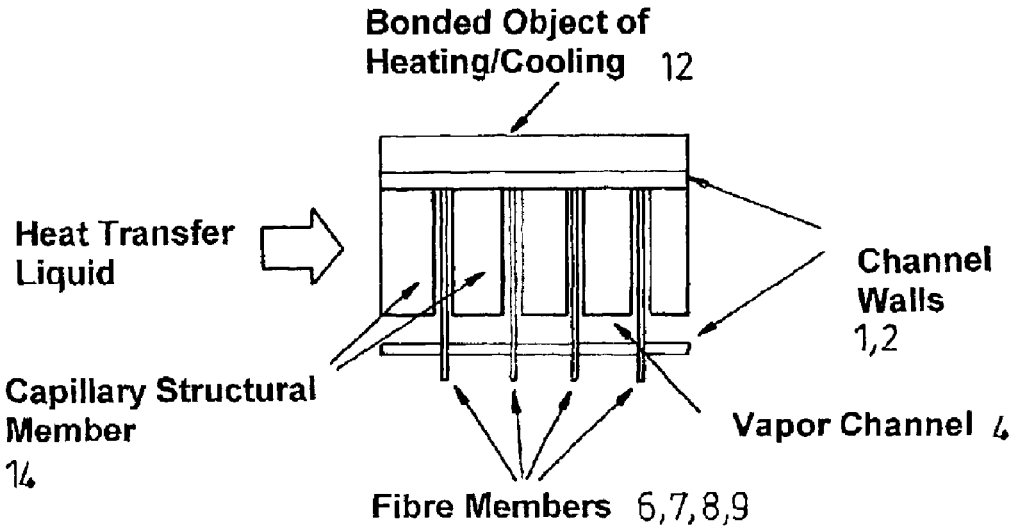
Figure 36:
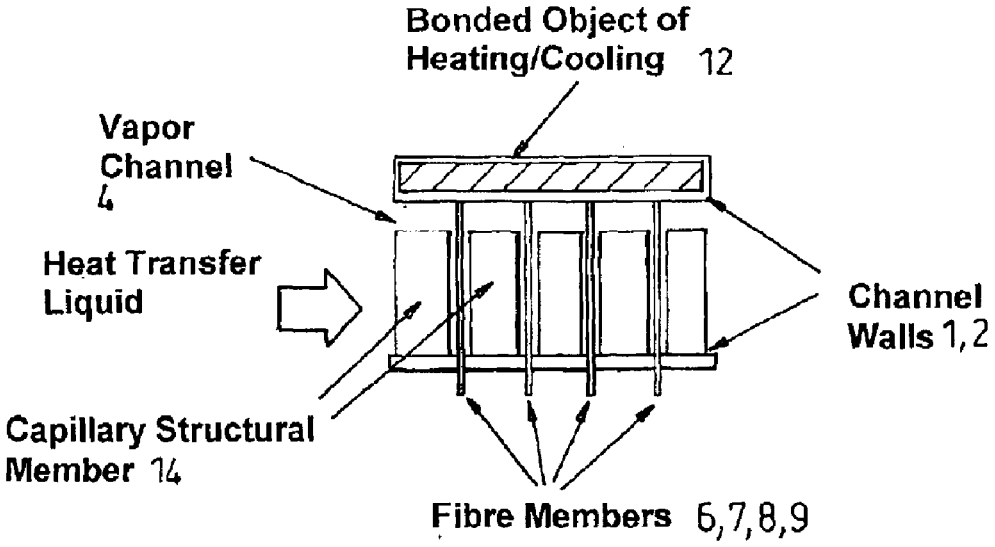
Figure 37:
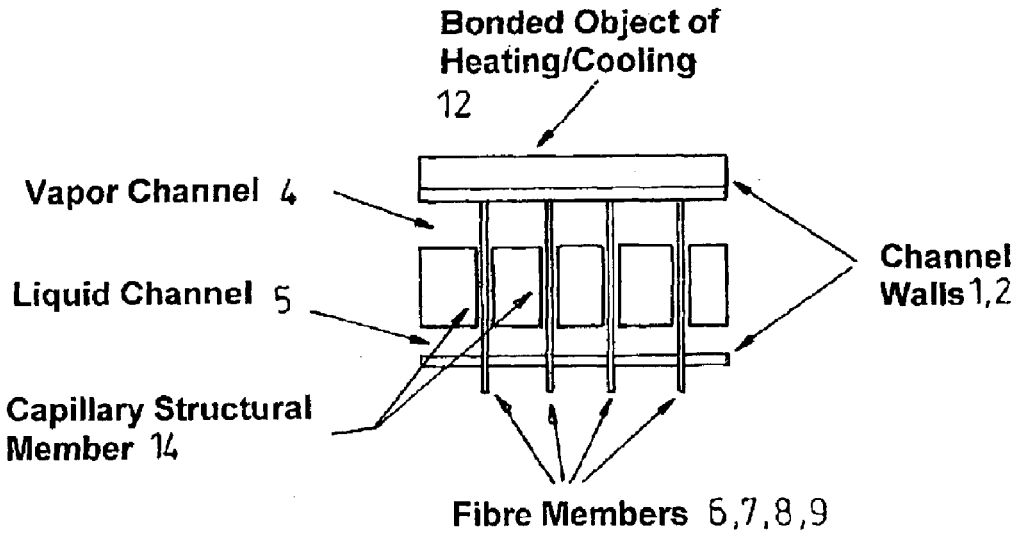
Figure 38:
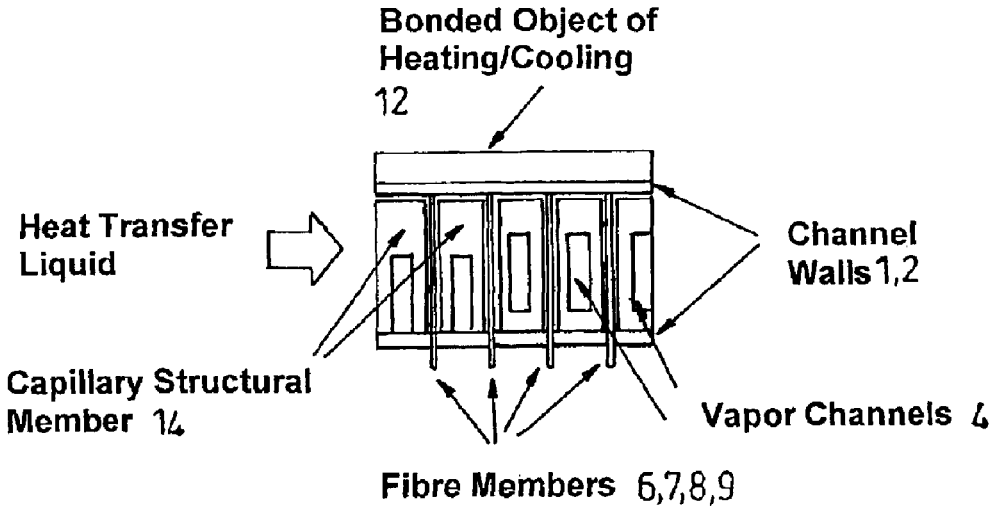

FIG. 35 is an alternative to an embodiment shown in FIG. 34, and in which a capillary structure is attached to a wall of the fibre heat exchange structure;

FIG. 36 is still an alternative to an embodiment shown in FIG. 34, and in which a porous media is attached to a different wall of the fibre heat exchange structure;

FIG. 37 is an illustration of a further alternative to an embodiment shown in FIG. 34 and in which a porous media is placed between walls of the fibre heat exchange structure, and vapour channels placed close to walls;

FIG. 38 is an alternative to an embodiment shown in FIG. 37, and in which a porous media is placed between the walls of the fibre heat exchange structure, and vapour channels placed inside the porous media.

Figure 1:
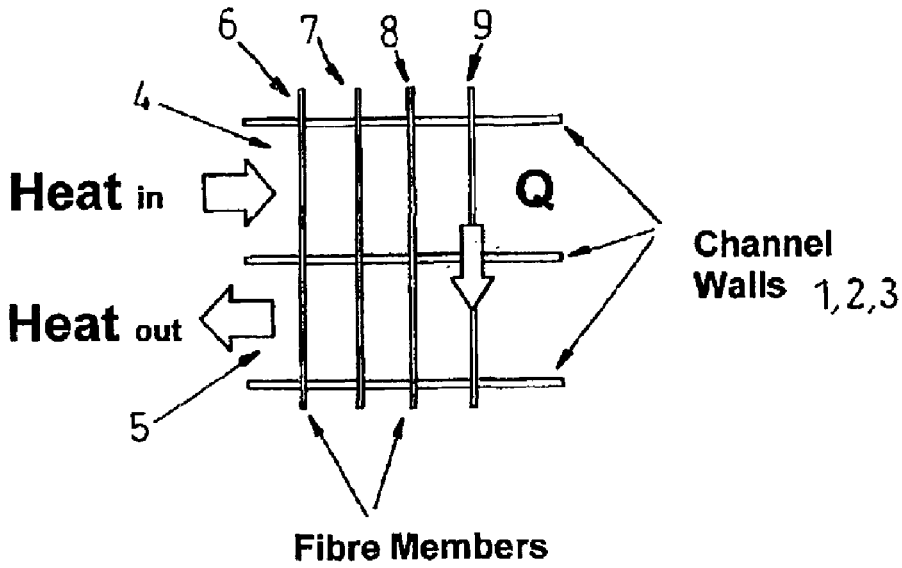
FIG. 1 is a partial cross sectional view of a plate fibre heat exchange structure with fibre members structure constructed in accordance with one aspect of the invention.

A first embodiment of a heat exchange structure constructed in accordance with one aspect of the invention is illustrated in a partial cross section in FIG. 1 of the accompanying drawings.

The heat exchange structure comprises a stack of plates 1,2,3 made of woven fibrous material or any suitable material, as said in the text of the invention, which define opposing walls of channels along which fluid can flow. In FIG. 1 only three plates are shown which define two closed channels 4,5. The plates 1,2,3 could be rectangular in shape and are encased within a housing (not shown) that defines the remaining walls of the channels 4,5. Openings in the housing or the plates (not shown) allow fluid to enter and to exit from the heat exchanger.

The plates 1,2,3 are held in a spaced apart arrangement, which can be substantially parallel to the adjacent plate or plates. Each plate 1,2,3 is constructed of a fibrous material and is produced by weaving or sewing together fibres or bundles of fibres, for example in the form of tapes or strips to form a sheet. A stitching technique could be also used. However, walls could be made from any suitable material—resinous, plastic, metal, etc.

A plurality of continuous fibre members 6,7,8,9 (of which four are illustrated in FIG. 1 extend through each of the plates 1,2,3 and hence the two channels. Each fibre member comprises an elongate fibre of carbon, silicon carbide or other material of suitable thermal conductivity. The fibres are aligned orthogonal to the plane of the plates and hence the flow of fluid through the channels. The concept "fibre" includes small diameter rods, plates, and ribbons.

In use, a fluid from which heat is to be extracted is passed along one of the channels 4,5. A heat transfer fluid into which heat from the hot fluid is to be sunk is passed along the adjacent channel 5,4. The fibre members 6,7,8,9 act to transfer heat by conduction along the fibres between the channels 4,5.

Of course, the heat exchange structure could be equally well suited to heating a fluid if a heat transfer fluid at an elevated temperature is used. Heat energy will then flow in the opposite direction along the fibre members 6,7,8,9.

Because the fibres of the fibre members 6,7,8,9 penetrate through the walls of the channels, the efficiency of heat transfer is directly dependent upon the thermal conductivity of the fibre members and their geometry. The fibres can also directly carry stresses that are applied along their length. If the fibre members did not pass through the plates, they would need to be thermally bonded to the plates as in some of the prior arts. This produces a weaker and less efficient structure.

The fibre members 6,7,8,9 may be provided in a variety of configurations and have a wide range of different cross-sections. FIG. 14 is an overhead view of a set of fibre members illustrating some of the various possible spatial arrangements of the fibre members within any of the heat transfer assemblies of the present invention.

Figure 2:
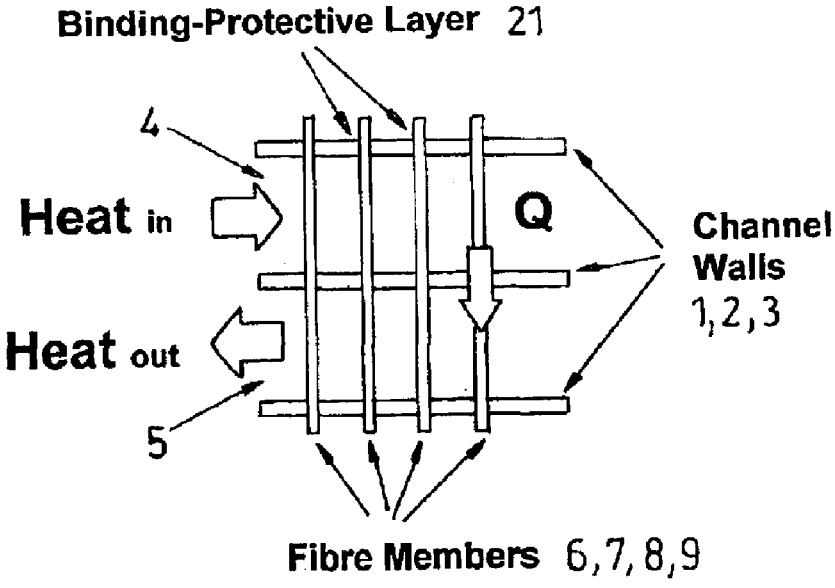
FIG. 2 is a partial cross sectional view of a modified plate heat exchanger with bonded/protected fibre members structure constructed in accordance with one aspect of the invention.

FIG. 2 is a partial cross sectional view of a modification of the plate heat exchanger of FIG. 1. Where possible, like reference numerals have been used to denote equivalent components. In this embodiment the plates and the fibre members are again woven together but are also impregnated with a protective and reinforcing binding material 21. This comprises suitable ceramics, and/or carbon, and/or metal, and/or a polymeric resin which provides additional reinforcement to the structure as well as protecting the fibres in the members from corrosive fluids that flow in the channels. Often, before an impregnation some additional materials should be deposited on the fibre surface in order to protect fibres from the process of impregnation. Heat can pass through the protective coating into the fibres for transfer from one channel to another channel.

Figure 3:
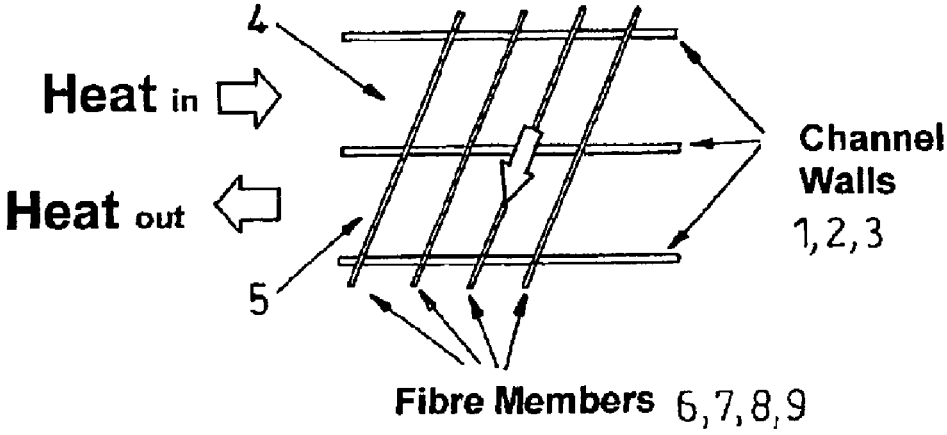
FIG. 3 is a partial cross sectional view of a plate heat exchanger with fibre members penetrating the structure not orthogonal to walls of the fibre heat exchange or the like structure constructed in accordance with one aspect of the invention.

FIG. 3 illustrates a different fibre heat transfer structure. In the described embodiment the fibre members 6, 7, 8, 9 are crossing walls 1, 2, 3 of the structure not orthogonally. The similar structure will be shown below in FIG. 9. The fibre members crossing walls at different angles improve mechanical and thermal properties of the fibre heat exchange structure. The shown embodiment of the heat exchanger can be made into a structural element of some machine, which provides great versatility. For example, it could be used as a structural part of an aircraft body or wing, or perhaps of the body of a spacecraft. To use part of a body or wing to act as a heat exchanger reduces the weight of the craft. Similar design could be used for structural materials, and moreover, such structural materials could be cooled/heated and thus provide a low thermal signature of crafts.

It will be readily appreciated that fibre members do not need to pass orthogonally through the walls and the channels. For example, an alternative arrangement is illustrated in FIG. 3 of the accompanying drawings which illustrates a fibre heat exchange structure in which fibre members 6, 7, 8, 9 are inclined relative to the walls of the fibre heat exchange structure. This is a partial cross sectional view of an embodiment of a fibre heat exchange structure in which the fibres are not orthogonal relative to the plane of the plates. Again only four fibre members 6, 7, 8, 9 and three plates 1, 2, 3 are shown although in practice many more may be provided.

In yet a further refinement, as shown in the embodiments illustrated in FIG. 4 and FIG. 5 of the accompanying drawings respectively, the channels defined between the plates of a heat exchanger may incorporate baffles 14, 15 which increase the strength of the assembly. In FIG. 5 three parallel plates 1, 2, 3 defining two channels are shown. The channels include baffles 14, 15 in the form of a corrugated or wavy sheet of fibrous or other material. The sheet extends across the width of the channel and is bonded or not bonded to the walls of the channels at its crests and its troughs. Of course, it also envisaged that the baffle may be formed by weaving or sewing fibres or sheets of fibrous material at the same time as the plates are constructed to produce a stronger assembly. The bonding could, for instance, be by way of a line of stitching.

In the alternative arrangement of FIG. 4, which is a perspective view of a further embodiment of the fibre heat exchange assembly, only two plates 1, 2 are provided to define a single channel down which heat transfer fluid can be passed. A corrugated baffle 14 divides the single channel into sub channels 4, 5. A different fluid can be passed along each of these sub-channels if desired. If baffles of the fibre structures shown in FIGS. 4 and 5 are porous then this is the embodiment shown in FIG. 11. Such embodiment can be used as the capillary thermal management device. A working fluid can be supplied through capillary baffles and take part in heat transfer either as a single phase or two phase working liquid. All embodiments shown in FIGS. 4, 5 and 11 also could be structural materials.

Figure 6:
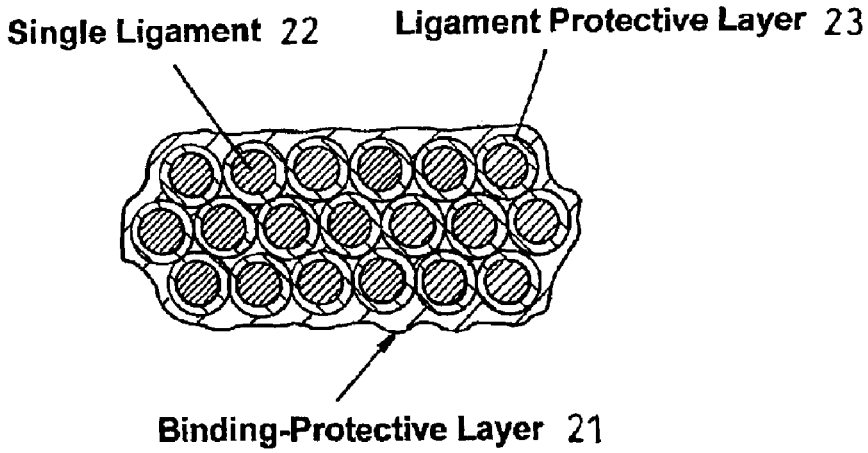
FIG. 6 is a cross sectional view of one fibre or structural member of the fibre composite structure.

FIG. 6 illustrates a fibre member inside structure. In this drawing a cross section view of a fibre member is shown, which no longer comprise a single fibre strand/ligament but instead is comprised of a number of fibre ligaments 22 in parallel which each pass through the channels and the walls fibres and are encased in a protective 23 and binding/matrix material 21 to form a composite structure. Each fibre ligament 22 is provided with its own protective layer 23 in addition to the final binding material 21. This construction allows fibre members of varying strengths, thermal parameters and cross sections to be produced. However, often a protection layer is not needed and only binding material—matrix is present. In the described manner the heat exchanger can be made into a structural element of some machine, which provides great versatility. For example, it could be used as a structural part of an aircraft body or wing, or perhaps of the body of a spacecraft. To use part of a body or wing to act as a heat exchanger reduces the weight of the craft. Similar design could be used for structural materials, and moreover, such structural materials could be cooled/heated and thus provide a low thermal signature of crafts.

Figure 7:
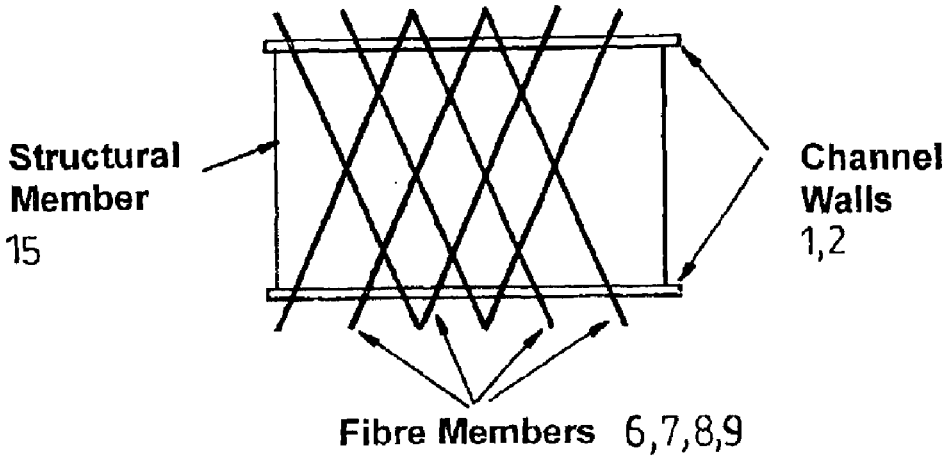
FIG. 7 is a partial cross sectional view of an embodiment of the fibre heat exchange structure or the like in which the fibre members are not orthogonal relative to the plane of the plates with an installed in structural member filling an entire space between walls. The shown embodiment could be important for structural material applications.

FIGS. 7 and 8 illustrate a cross sectional view of the embodiment similar to shown in FIGS. 4 and 5, but with fibre members 6, 7, 8, 9 not orthogonal to walls, as it is shown in FIG. 3, and one of the structural elements 14, 15 filling the entire space between walls 1, 2. Only one structural member 15 is installed in the fibre structure of FIG. 7, and two structural members 14, 15 are installed into the fibre structure shown in FIG. 8. The structural member 15 in FIGS. 7 and 8 could be comprised from plastic materials or other materials including porous/fibrous. In this case the embodiments can be used as the capillary thermal management devices. All embodiments shown in FIGS. 4, 5 and 11 also could be structural materials.

A further embodiment of a fibre heat exchange structure in accordance with the present invention is shown in the cross sectional view of FIG. 9. In this embodiment the fibre members are grouped into two groups. A first group of fibre members 6, 7 subtend an acute angle (A) with one wall of a channel whilst the second group 8, 9 subtend an obtuse angle (180+A). The fibre members of each group are arranged in several rows of evenly spaced fibre members to criss-cross the channels.

FIG. 10 is a perspective view of part of the fibre heat exchange structure illustrated in FIG. 9. From this figure the relative location of the fibre members can be clearly seen.

FIG. 11 is a perspective view of the structure similar to the fibre heat exchange structure illustrated in FIG. 4. The difference is that the baffle of the fibre structures shown in FIG. 11 is porous. This embodiment can be used as the capillary thermal management device. A working fluid can be supplied through the porous/capillary baffle and take part in heat transfer either as a single phase or two phase working liquid. The embodiment shown in FIG. 11 also could be the structural material.

Although the plates defining the walls of the channels of the above described and illustrated heat transfer assemblies are planar, it is possible to construct a heat transfer device in other configurations.

As shown in FIG. 12 of the accompanying drawings, which is a cross sectional view of an embodiment of a fibre heat exchange structure, three cylindrical plates 1, 2, 3 may be provided. The plates 1, 2, 3 are nested one inside the other around a common axis to define two closed walled channels 4, 5. Fin shaped fibre members 6, 7 extend radially through the walls and axially along the channels to form a regular structure. It is envisaged that such a construction will find application in the cooling/recuperating of exhaust gas that has passed through a gas turbine. For instance, the turbine (not shown) may be located within the innermost cylindrical plate 1 to produce a compact assembly. Again, because the fibre members pass through the walls and the channels efficient heat transfer and improved stress properties can be achieved.

A further embodiment of a fibre heat exchange structure in accordance with the present invention is shown in the cross sectional view of FIG. 13. In this embodiment the corrugated fibre structural member/baffle is installed into the channel space between cylindrical walls 1, 2 subdividing this channel space into a number of sub channels. The fibre members are grouped into several groups, and only three groups are shown. A first group of fibre members 6, 7 subtend an acute angle (A) with one wall of a channel whilst the second group subtend an obtuse angle (A+ some angle). The third group has an additional angle shift. Thus, the efficiency of the heat exchange structure can be improved whilst geometry of channels is convenient for fluid connections.

FIG. 14 shows different geometry of fibre members distribution inside channels, which have a drastic effect on the fibre heat exchange structure pressure drop and effectiveness.

FIG. 15 shows the evolution of the fibre heat exchange structure (a) into a heat sink with partial cross sectional views of an embodiment of a heat sink (b) in accordance with the present invention bonded to an object 12 to be cooled or heated and with an embodiment of a heat sink (c) with an object 16 to be heated/cooled deposited on a wall.

FIG. 12 is a partial cross sectional view of a first embodiment of a heat sink in accordance with the present invention bonded to an object 12 to be cooled or heated. The heat sink 120 comprises a pair of spaced apart, planar, parallel plates 1, 2 which define opposing sides of a channel along which heat transfer fluid can be passed. As described hereinbefore a plurality of fibre members 6, 7, 8, 9 are provided which pass through the two plates 1, 2 and hence the channel. One end of each of the fibre members 6, 7, 8, 9 is placed in thermal contact with an object 12 to be heated or cooled. The fibre members 6, 7, 8, 9 then act to dissipate heat from the object 12 to fluid in the channel.

In another embodiment, the invention may provide an electronic device or component in which heat conducting fibres are embedded within the device to be cooled or surround the device to be cooled.

As shown in the embodiment of FIG. 17, which is a cross sectional view of a first embodiment of a combined electronic device and the fibre heat exchange structure. An object to be cooled/heated embeds within the ends of a number of fibre members 6, 7, 8, 9. In the figure, four such members are shown although in practice many more can be provided. A single plate 1 is provided which lies in parallel with the surface of the device to be cooled/heated from which the fibre members protrude. This defines a single fluid receiving channel 5 between the plate 1 and the device. The fibre members 6, 7, 8, 9 extend across the channel and through the plate 1. Thus, heat from the circuit can pass along the fibre members 6, 7, 8, 9 for dissipation into the fluid in the channel.

Various modifications to the assembly of FIGS. 16 and 17 can of course be made within the scope of the present invention. In some cases, it may be necessary or desirable to electrically isolate the fibres from the object. This may be necessary where the fibres are electrically conductive such as carbon or graphite fibres. For example, as shown in FIG. 18 the ends of embedded fibre members 6, 7, 8, 9 are covered with electrically insulting material 24. As shown in FIG. 19 of the accompanying drawings, an electrical insulating layer 24 can be provided between the heat sink wall/substrate 2 and the object 12 to be heated or cooled. The ends of the fibre members are thermally in contact with the electrical insulation layer 24, and may be embedded in the layer if required. Also, as it is shown in FIG. 20, three fibrous plates 1, 2, 3 defining two parallel channels could be provided. More than two channels are also envisaged, and each one may be adapted to carry a different heat exchange fluid. FIG. 26 is a further modified fibre heat transfer assembly in which the walls 1, 2 of the heat transfer assembly and the fibre members 6, 7, 8, 9 are covered with electrically insulating material.

FIG. 22 is a perspective view of part of the fibre heat exchange structure illustrated in FIG. 19. From this figure the relative location of the fibre members and the electrical insulation layer can be clearly seen.

Other heat transfer assemblies are envisaged. For example, FIG. 23 is an illustration of a three dimensional micro-electronic circuit with the integral cooling fibre heat exchange structure in accordance with one aspect of the invention.

The assembly of FIG. 23 comprises two parallel spaced apart fibrous plates 1, 2, which define a channel along which cooling fluid, such as air, can flow. Fibre members 6, 7, 8, 9 extend through the walls of the plates and the channel. A part of the fibre members 6, 7, 8, 9 (four are shown) surface provides a support for a respective three-dimensional integrated circuit 25.

In another embodiment, the invention may provide an electronic device or component in which heat conducting fibres are embedded within the device to be cooled or surround the device to be cooled. Although not shown in the drawings, the fibres could encase one or more, and preferably all sides of the device to provide a shield that protects the device form external electromagnetic radiation fields. This is especially advantageous if electrically conductive fibres are used which can be earthed to a suitable earth point.

FIG. 24 is an illustration of a micro-electronic circuit 12 integrated with a heat sink defined by two walls 1, 2 and fibre members 6, 7, 8, 9. The microchip is protected by fibre members 6, 7, 8, 9 from EMI in accordance with one aspect of the invention. FIG. 32 illustrates the heat sink defined by walls 1, 2, the heat conducting fibre members 6, 7, 8, 9 and optical fibre members 32 integrated with the microchip 12. The light source 31 provides special frequency light to heal the microchip from radiation damage.

An alternative embodiment of a heat sink assembly, again incorporating many features of the embodiments of FIGS. 1 to 24 is shown in FIGS. 25 to 27 of the accompanying drawings.

The shown heat sink comprises a hollow cylindrical tube 1 through which heat exchange fluid can be passed. A plurality of fibre members 6, 7 pass through the cylinder and the cylinder walls. One end of each of the fibre members 6, 7 passes through the cylinder 1 in the location of a first area of the cylinder which, in use, is adjacent the object 12 to be cooled/heated. The opposite end of each member 6, 7 passes through the cylinder wall at a different point. As shown, the fibre members 6, 7 and the wall 1 form a substrate originating at the first area.

As shown in FIG. 25 and FIG. 27 of the accompanying drawings the fibre members may comprise linear members such as rods or plates made up of one or more fibres. Alternatively, the fibre members 6, 7 may be stepped so as to present a greater area of fibre member within the cylinder.

An electric fan 17, shown in FIG. 27 but omitted from FIGS. 25 and 26 of the accompanying drawings is attached to one end of the cylinder to blow fluid along the channel. In use, the heat sink/substrate is attached to a device such as an electronic circuit formed as a chip, which is to be cooled. The said microchip could be integrated with the heat sink. Power for the fan can then be provided from contacts provided as a part of the substrate for the electronic circuit.

FIG. 28 is an illustration of an embodiment of a transmitter/receiver for light or other forms of electromagnetic radiation. The fibre assembly comprises a plurality of fibre members 6, 7 which extend from a transducer/generator 1 and which include continuous fibres along which the radiation can be propagated. Each of the fibre members 6, 7 is deliberately charged with an electrical potential which aligns the fibres. In the example shown, the fibre members comprise single carbon fibres, which all have an electrical charge and so repel one another to produce spaced fibre members assembly which fan out from the transducer. A number of layers of fibre members can be provided.

In alternative embodiment FIG. 29 fibre members 6, 7 have bonded together ends. If charged they produce the bottle shape structure, which can be used similar to FIG. 28 embodiment.

FIGS. 30 and 31 illustrate modifications of a fibre heat transfer assembly (such as a heat sink or heat exchanger) in which one or more of the plates or the fibre members are connected to a source of electrical potential to improve heat exchange by an electrical field interaction with a fluid dipoles or/and by an interaction between free charges and molecules. FIG. 30 illustrates such a modified fibre heat transfer assembly in which the fibre members 6, 7, 8, 9 that pass through the channels are electrically charged; and FIG. 31 is a further modified fibre heat transfer assembly in which the walls 1, 2, 3 of the fibre heat exchange assembly are electrically charged instead of the fibre members 6, 7, 8, 9.

FIG. 33 is an illustration of a heat transfer assembly with a capillary wall. The heat transfer assembly is comprised of liquid 5 and vapour 4 channels reinforced with structural members 14, 15. The channels are separated by a capillary wall 2. The entire assembly is penetrated by fibre members 7, 8, which hold the structure from internal pressure. Heat absorbed by the assembly through wall 1 will be spread by the wall and then conducted through fibre members 6, 7 and structural member 14 to the porous wall 2. Liquid supplied through a liquid channel 5 will evaporate on the surface of contact between fibre 6, 7, structural 14 members and the porous wall 3. The structural members 14 and 15 in this assembly are used for structural support and to conduct heat from wall 1 to porous wall 2.

FIG. 34 is an example of a single channel capillary cooling device the object of heating/cooling 12 attached to the wall 1.

It is appreciated that most of the devices presented in this patent can work in heating or cooling mode. In the case of a two-phase device such as the capillary pump devices in the heating mode, the condensation will occur on the elements of the heat transfer assembly and the capillary structure will pump liquid from the condensation area instead of supplying liquid into the evaporating area. Simplified, just the cooling (evaporating) mode is described; however, these devices can work as well in heating (condensing) mode.

The channel wall 1 is penetrated by fibre members 6, 7, 8, 9 or it can be comprised from the fibre members. These members are extended into the channel and transfer heat from the object of heating/cooling 12 into the channel 4. The fibre members 6, 7, 8, 9 are located close enough to form the capillary structure which is pumping cooling liquid through the fibrous structure. The evaporation or cooling fluid cools down the fibre members and through them the object of heating/cooling.

In FIG. 35, the additional fibrous structure 14 is inserted into the channel 4 of the heat transfer assembly. This structure can reinforce the heat transfer assembly and act as a structural member 14, or it can form the wall 1 of the heat transfer assembly, and be attached to the object of heating/cooling 12. Cooling liquid is supplied through the capillary structure and evaporates on the fibre members 6, 7, 8, 9. The rest of the channel is used for vapour circulation. This additional capillary structure forms the wall connected to the object of heating/cooling.

In FIG. 36, the additional fibrous structure 14 is inserted into the channel 4 of the heat transfer assembly. It is attached to the wall 2 of the channel 4. This structure can reinforce the heat transfer assembly and act as a structural member 14, or it can form the wall 2 of the heat transfer assembly. Cooling liquid is supplied through capillary structure and evaporates on the fibre members 6, 7, 8, 9. The rest of the channel is used for vapour circulation. The vapour channel prevents direct conduction of heat from the wall to the porous structure.

In FIG. 37, the additional fibrous structure 14 is inserted into the middle of channel 4 of the heat transfer assembly. It separates the liquid and vapour channels. This structure can reinforce the heat transfer assembly and act as a structural member 1. Cooling liquid is supplied through the liquid channel 5, and the capillary structure 14 and evaporates on the fibre members 6, 7, 8, 9. The rest of the channel is used for vapour 4 circulation. The vapour channel prevents direct conduction of heat from the wall to the porous structure.

In FIG. 38, the additional fibrous structure 14 occupies the entire space between the channel walls 1 and 2. Vapour channel 4 is formed inside the capillary structural member 14. It can be formed close to one or the other wall of the channel or close to the fibre member or away from it. Heat is conducted through fibre members 6,7,8,9. The cooling fluid is evaporated through the capillary structure 14 and circulated through vapour channel 4.

What is claimed is:

1. A heat transfer assembly, comprising:

a plurality of channel walls, each said channel wall being made from a textile fibrous material formed of independently displaceable elongated fibres, at least a first channel and a second channel being defined at opposing sides of at least one of said plurality of said channel walls, a first fluid at a first temperature being received in said at least first channel, and a second fluid at a second temperature being received in said at least second channel separated from the first fluid by said at least one of said plurality of the channel walls, and a plurality of fibre members, each of said plurality of fibre members including at least one elongated thermally conductive fibre extending substantially axially along said each fibre member between the first fluid and the second fluid through said plurality of the channel walls, thus retaining relative disposition between said channel walls to form a structurally enhanced integral heat transfer unit, and for transferring heat between the first fluid and the second fluid.

2. The heat transfer assembly according to claim 1, wherein said first and second channels have at least one triangularly shaved cross-section thereof.

3. The heat transfer assembly according to claim 1, further comprising a stack of said channel walls, either of said first and second channels being defined between adjacent of said channel walls.

4. The heat transfer assembly according to claim 3, further including at least one structural member positioned in said first and second channels.

5. The heat transfer assembly according to claim 4, wherein said at least one structural member includes a corrugated sheet extending across the width of said first and second channels.

6. The heat transfer assembly of claim 1, wherein said at least one channel wall is formed from said elongated fibres by sewing/weaving/stitching said elongated fibres.

7. The heat transfer assembly of claim 1, wherein an angle between said at least one elongated fibre member and said at least one channel wall is an obtuse or acute angle.

8. The heat transfer assembly of claim 3, wherein said channel walls and said fibre members form a flexible structure of a changeable controlled shape.

* * * * *